US008175512B2

(12) United States Patent
Cornwell

(10) Patent No.: US 8,175,512 B2
(45) Date of Patent: May 8, 2012

(54) LOOK THROUGH MODE OF JAMMING SYSTEM

(75) Inventor: James Cornwell, Inyokern, CA (US)

(73) Assignee: Kaonetics Technologies, Inc., Inyokern, CA (US)

( * ) Notice: Subject to any disclaimer, the term of this patent is extended or adjusted under 35 U.S.C. 154(b) by 286 days.

(21) Appl. No.: 12/518,217

(22) PCT Filed: Dec. 10, 2007

(86) PCT No.: PCT/US2007/086975

§ 371 (c)(1),
(2), (4) Date: Jan. 26, 2010

(87) PCT Pub. No.: WO2009/048480

PCT Pub. Date: Apr. 16, 2009

(65) Prior Publication Data

US 2010/0128761 A1 May 27, 2010

Related U.S. Application Data

(60) Provisional application No. 60/873,588, filed on Dec. 8, 2006.

(51) Int. Cl.
*H04K 3/00* (2006.01)

(52) U.S. Cl. ... 455/1; 455/67.11; 455/67.13; 455/115.1; 375/219

(58) Field of Classification Search ..... 455/1, 3.05, 455/411, 434, 9, 515, 528, 67.11, 67.13, 455/67.16, 552.1, 562.1, 565, 150.1, 177.1, 455/222, 283; 342/357.12, 378, 17, 21, 14, 342/15, 18 E; 375/206, 208, 209, 210, 219; 178/18.01, 18.02

See application file for complete search history.

(56) References Cited

U.S. PATENT DOCUMENTS

| | | | | | |
|---|---|---|---|---|---|
| 3,870,995 | A | * | 3/1975 | Nielson | 342/14 |
| 4,170,757 | A | * | 10/1979 | Skudera et al. | 380/34 |
| 4,688,041 | A | * | 8/1987 | Cronson et al. | 342/17 |
| 4,703,327 | A | * | 10/1987 | Rossetti et al. | 342/44 |
| 4,876,545 | A | * | 10/1989 | Carlson et al. | 342/14 |
| 5,859,392 | A | * | 1/1999 | Petty | 178/18.01 |
| 5,999,561 | A | * | 12/1999 | Naden et al. | 375/142 |
| 2004/0239559 | A1 | * | 12/2004 | King et al. | 342/357.12 |

FOREIGN PATENT DOCUMENTS

| | | |
|---|---|---|
| WO | WO 2006/020864 | 2/2006 |
| WO | PCTUS2007086975 A3 | 6/2009 |

* cited by examiner

*Primary Examiner* — Tan Trinh

(74) *Attorney, Agent, or Firm* — Stroock & Stroock & Lavan LLP

(57) ABSTRACT

A system includes a generator and at least one device. The generator includes a waveform oscillator and a blanking pulse generator. Each device includes a transmit antenna, a receive antenna, an antenna unit, a mixer and a detector. The antenna unit includes a receiver coupled to the receive antenna, an amplifier coupled to the receiver and a transmitter coupled to the transmit antenna and the blanking pulse generator. The mixer has inputs coupled to the amplifier and the waveform oscillator. The detector is coupled to the mixer.

34 Claims, 17 Drawing Sheets

LOOK THROUGH MODE OF JAMMING SYSTEM

BACKGROUND OF THE INVENTION

1. Field of the Invention

The present invention relates to electronic countermeasure jamming systems that are capable of interrupting radio links from triggering devices used in connection with improvised explosive devices. In particular, the invention related to a look through mode for sensing the presence of radio links.

2. Description of Related Art

Known countermeasure systems have diverse broadband radio signal generators that are fed into a relatively simple antenna. The antenna attempts to have omni-directional coverage. The simplest antenna is a half dipole oriented vertically at the center of the area to be protected by jamming The problem with such antennas is that they do not have spherical coverage patterns for truly omni coverage. Coverage of such a simple antenna appears shaped like a donut with gaps in coverage above and below the plane of the donut because the simple dipole cannot operate as both an end fire antenna and an omni antenna. More complex antennas may add coverage in end fire directions but generate interference patterns that leave gaps in coverage.

In an environment where small improvised explosive devices (IED) are placed in airplanes, busses or trains and triggered by radio links distant from the IED, it becomes more important to successfully jam the radio link without gaps in jamming system coverage.

Known omni directional systems radiate to provide 360 degree coverage on a plane with elevations plus or minus of the plane. Very few truly omni directional antenna systems are known to create coverage in three dimensions on a unit sphere. Difficulties are encountered that include, for example, the feed point through the sphere causes distortion of the radiation pattern, metal structures near the antenna cause reflections that distort the radiation pattern, and the individual radiating element of an antenna inherently does not produce a spherical radiation pattern. In addition, providing a spherical radiation pattern over a broad band of frequencies can be extremely difficult. Antenna structures intended to shape the radiation pattern at one frequency can cause distortion in the radiation pattern at another frequency.

SUMMARY OF THE INVENTION

A system includes a generator and at least one device. The generator includes a waveform oscillator and a blanking pulse generator. Each device includes a transmit antenna, a receive antenna, an antenna unit, a mixer and a detector. The antenna unit includes a receiver coupled to the receive antenna, an amplifier coupled to the receiver and a transmitter coupled to the transmit antenna and the blanking pulse generator. The mixer has inputs coupled to the amplifier and the waveform oscillator. The detector is coupled to the mixer.

BRIEF DESCRIPTION OF DRAWINGS

The invention will be described in detail in the following description of preferred embodiments with reference to the following figures.

DETAILED DESCRIPTION OF PREFERRED EMBODIMENTS

A new system for sensing RF signals operates in a look through mode in conjunction with a jamming system. The system, as more fully described below, includes a generator and at least one device. The generator includes a waveform generator and a blanking pulse generator. Each device includes at least two antennas, an antenna unit, a mixer and a detector. The antenna unit includes a receiver coupled to a receive antenna, an amplifier coupled to the receiver and a transmitter coupled to a transmit antenna and the blanking pulse generator. The mixer has inputs coupled to the amplifier and the waveform generator. The detector is coupled to the mixer.

Figure 2:
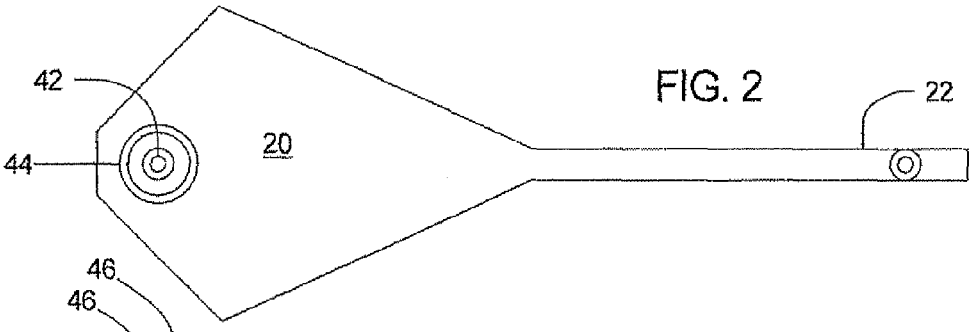
FIGS. 2 and 3 are plan views of the antenna of FIG. 1 from the obverse and reverse sides, respectively.
Figure 1:
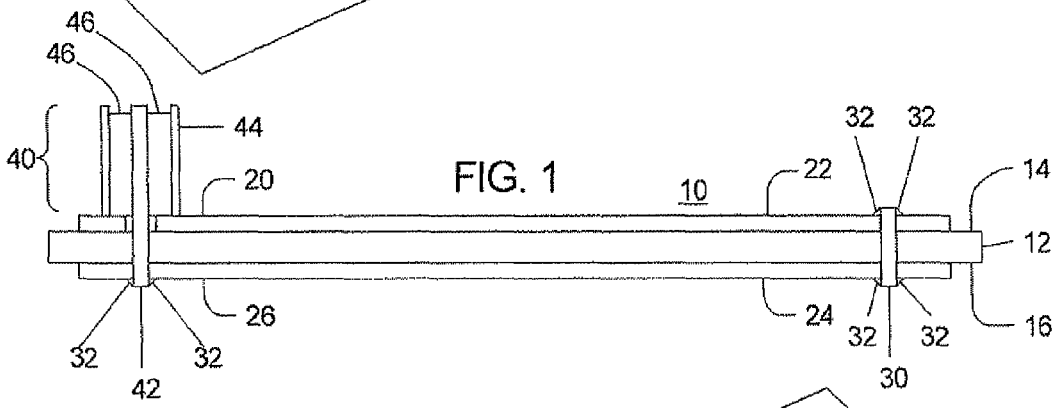
FIG. 1 is a sectional view of an antenna as might be used in an embodiment of an antenna system.
Figure 3:
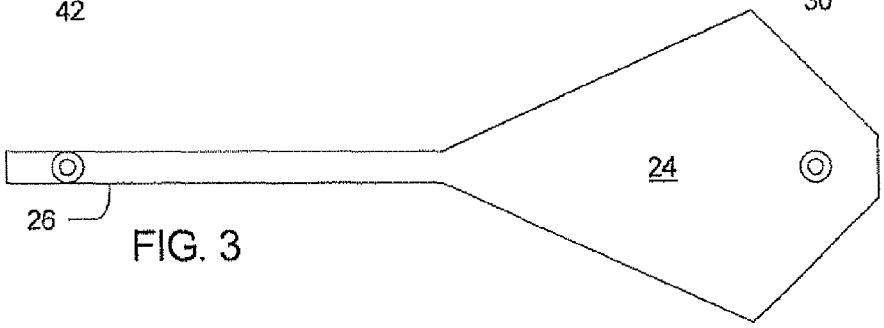

In FIGS. 1-3, an antenna 10 of a central integrated jamming system includes a planar shaped insulating substrate 12 extending in a principal plane of the antenna. Insulating substrate 12 has an obverse side 24 and a reverse side 26. The antenna 10 further includes a first radiating element 20 and a connected first conductor 22 disposed on the obverse side 14 and also includes a second radiating element 24 and a connected second conductor 26 disposed on the reverse side 16. The antenna 10 further includes a coupling conductor 30 that couples the second radiating element 24 and the first conductor 22. The antenna 10 further includes a coupler 40 having a first signal conductor 42 and a second signal conductor 44. The first signal conductor 42 is coupled to the second conductor 26, and the second signal conductor 44 is coupled to the first radiating element 20.

In operation and as depicted in FIGS. 1-3, applied currents flow from signal conductor 42 through conductor 26, through radiating element 24, through coupling conductor 30, through conductor 22, through radiating element 20 to conductor 44. When the currents are RF signal currents, at a broad bandwidth about certain frequencies, radiating elements 20 and 24 tend to resonate and operate as an antenna. The radiation that emanates from a radiating element tend to emanate from the edge of the element (e.g., the edge of the etched copper, generally flat, shape).

Antenna 10 has a shape similar to a "bow tie" antenna, and it functions as a broad band antenna. The two halves of the "bow tie" are preferably disposed on opposite sides of the insulating substrate 12, but may, in other variations, be formed on the same side. Antenna 10 is preferably fed from an end point instead of a center point as is common with "bow tie" style antennas. However, in other variations, antenna 10 may be fed from other point, such as the center. In one variation of this antenna, the entire antenna is formed from a double sided copper clad epoxy-glass printed wiring board. In such case, conductor 30 is typically a plated through hole, but may be a rivet or pin held in place by solder filets 32 as depicted in FIGS. 1-3. Other manufactures of the same structure are equivalent. The coupler 40 may be an SMC connector, a BNC connector or other connector suitable at RF frequencies. Typically, the coupler 40 will have insulating dielectric material between conductor 42 and conductor 44.

Figure 4:
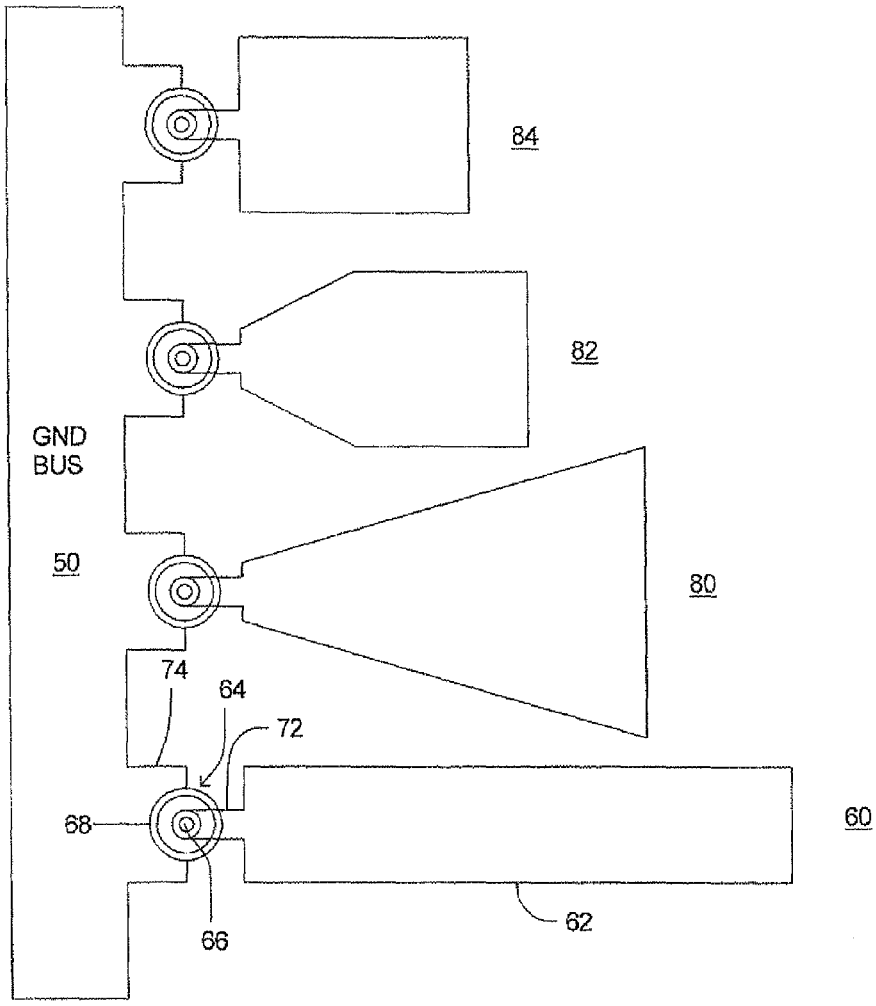
FIG. 4 is a plan view of several antennas as might be used in an embodiment of the antenna system.

In FIG. 4, plural antennas are depicted. These antennas are formed on a planar shaped insulating substrate extending in a principal plane of the plural antennas. Each antenna is formed from conductive material, preferably copper, disposed on an obverse side of the insulating substrate. Antenna 60 includes an antenna radiating element 62 and at least a portion a ground conductor 50 (also referred to as ground bus 50) disposed on the obverse side of the insulating substrate. Antenna 60 further includes a coupler 64 having a first signal conductor 66 and a second signal conductor 68. A feed connects coupler 64 to ground conductor 50 and antenna radiating element 62. In particular, the first signal conductor 66 of the coupler 64 is coupled through a first feed portion 72 to the radiating element 62, and the second signal conductor 68 of the coupler 64 is coupled through a second feed portion 74 to the ground conductor 50.

In operation, applied RF signal currents fed through coupler 64 pass though feed portions 72, 74 into ground bus 50 and radiating element 62. From there, electric fields extend between ground bus 50 and the radiating element 62 in such a way to cause RF signals to radiate from antenna 60.

In alternative embodiments, any one or more of antennas 80, 82 and 84 are similarly formed on the same insulating substrate. Each alternative antenna embodiment is varied by size and shape to meet frequency requirements and impedance matching requirements according to "radiator" technology. The size and shape of the feed portions 72, 74 are defined to match impedances from the coupler 64 to the radiating element of the antenna.

Figure 5:
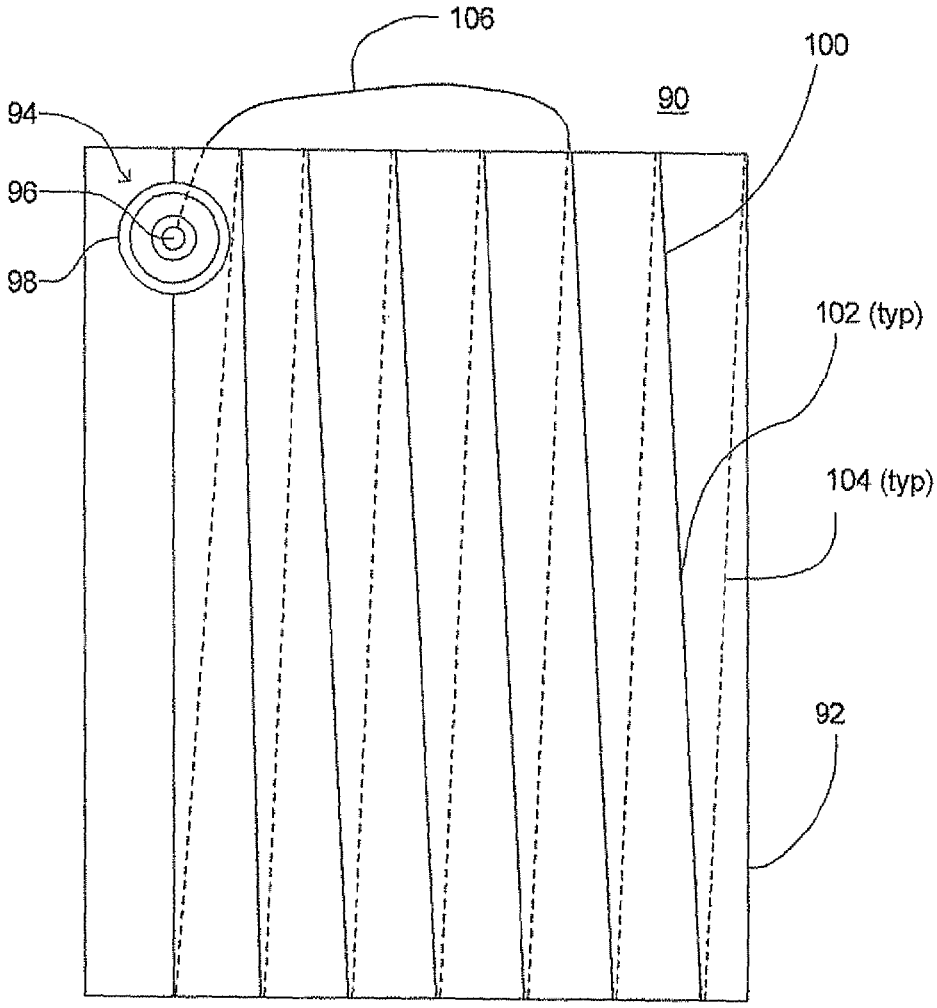
FIG. 5 is a plan view of another antenna as might be used in an embodiment of the antenna system.
Figure 6:
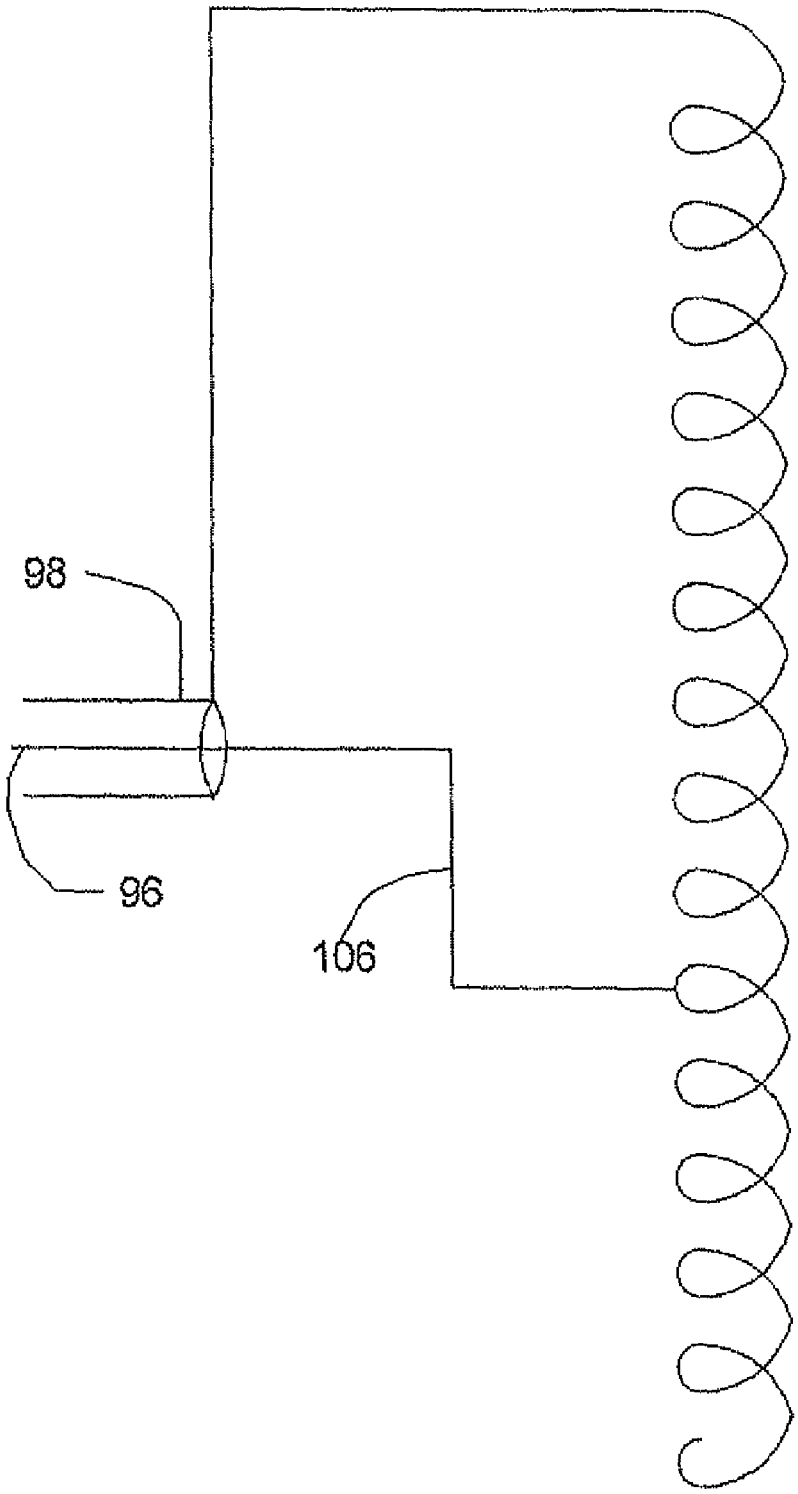
FIG. 6 is a schematic diagram of the antenna of FIG. 5.

In FIGS. 5-6, an antenna 90 includes a planar shaped insulating substrate 92 extending in a principal plane of the antenna. Insulating substrate 92 has an obverse side and a reverse side. Antenna 90 further includes a coupler 94 having a first signal conductor 96 and a second signal conductor 98. Antenna 90 further includes a wire 100 wound in plural turns around the insulating substrate 92. One half of each turn (collectively 102) extends across the obverse side of the substrate, and the other half of each turn (collectively 104) extends across the reverse side of the substrate. In an example of antenna 90, there are 32 turns in the winding. In one example, wire 100 is a wire having a diameter defined by an American Wire Gauge number selected from a range that varies from AWG 18 to AWG 30. If greater current is anticipated, AWG 16 wire might be used. Alternatively, other forms of conductor wires might be used; for example, the wire may be a flat ribbon conductor. The insulating substrate 92 might be an epoxy-glass substrate double clad with copper conductor and etched to form half turns 102 on the obverse side and half turns 104 on the reverse side. The ends of the half turns on the obverse side are connected to the ends of the half turns on the reverse side with plated through holes, rivets, pins or other through conductors as discussed with respect to FIGS. 1-3.

Antenna 90 further includes a tap conductor 106 coupled between the first signal conductor 96 of coupler 94 and a predetermined one of the plural turns of the wire 100. The predetermined turn number is determined during early design stages and may be easily defined by trying several different turn numbers and measuring the antenna's performance A first end of the plural turns of wire 100 is coupled to the second signal conductor 98.

In operation, applied RF signal currents fed through coupler 94 pass though conductor 96, through tap wire 106 to the predetermined one of the plural turns of wire 100, and from there through a portion of wire 100 to the first end of wire 100 to conductor 98. Additional turns of wire 100 beyond the driven turns between the first end of wire 100 and tap conductor 106 are parasitically driven.

Figure 7:
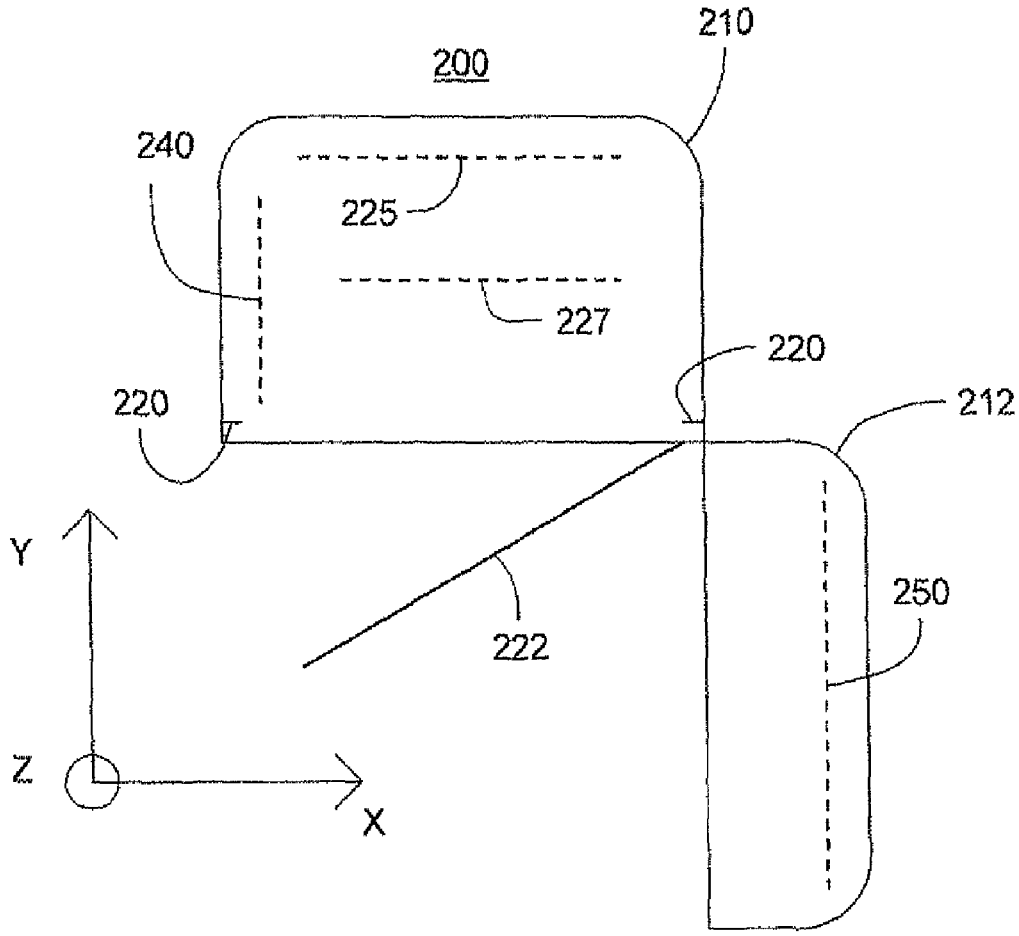
FIGS. 7 and 8 are two orthogonal views of an embodiment of an antenna system.
Figure 8:
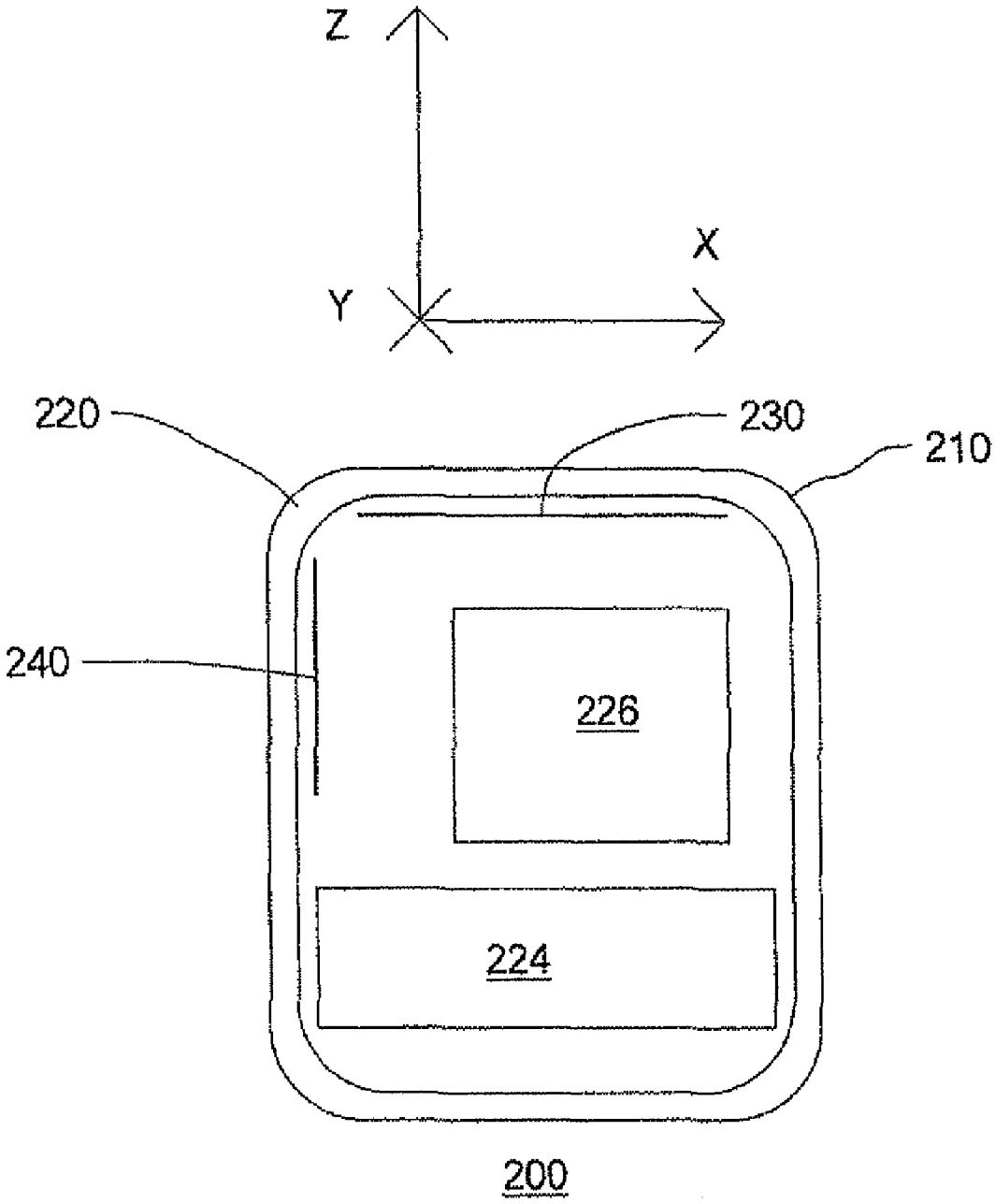

In FIGS. 7-8 an antenna system 200 is depicted. Antennas are mounted within portable case 210 and lid 212. Additionally, conductive control panel 222 is mounted to case 210, preferably by hinges. The case and lid are formed from a non-conductive material such as high impact resistant plastic or rubber. A conductive grounding ring 220 is installed inside the case. Electronic modules 224 and 226 are also installed in the case. Electronic module 224 has an equivalent conductive plane 225, and electronic module 226 has an equivalent conductive plane 227.

The electronic modules may be placed in locations other than those depicted in FIGS. 7 and 8; however, since their equivalent conductive plane may operate as a partial ground plane and reflect RF signals radiated from the antennas, the location of the electronic modules must be taken into account at the time of the design of antenna system 200. Different size, weight, cooling, RF signal and battery power requirements may be imposed on antenna system 200, depending on the application. Therefore, the locations depicted in FIGS. 7 and 8 should be regarded as a starting point and the locations and specific antenna parameters are adjusted to meet imposed requirements.

In a first embodiment of an antenna system, the antenna system includes plural antennas. Each antenna is different than every other antenna, and each antenna is characterized by a principal plane. A principal plane of a first antenna 230 is oblique to a principal plane of a second antenna. The second antenna may be located and oriented as depicted by antenna 240 or 250 in FIGS. 7-8. Much as is described with respect to the antenna depicted in FIGS. 1-3, the first antenna 230 includes a first insulating substrate extending in the principal plane of the first antenna. The first antenna further includes a first radiating element and a connected first conductor and includes a second radiating element and a connected second conductor. The first antenna further includes a coupling conductor coupling the second radiating element and the first conductor. The first antenna further includes a first coupler having a first signal conductor and a second signal conductor. The first signal conductor is coupled to the second conductor, and the second signal conductor is coupled to the first radiating element. The first antenna 230 is not shown in FIG. 7 for clarity, but FIG. 8 depicts an end view of the first antenna 230. The principal plane of the first antenna 230 extends in the X and Y directions. The principal planes of the first and second antennas are oblique; however, in some variants, the planes are substantially orthogonal.

In a first variant of the first embodiment of the antenna system, the second antenna is located and oriented as antenna 240 in FIGS. 7-8. Much as is described with respect to the antenna depicted in FIG. 4, second antenna 240 includes a second insulating substrate extending in the principal plane of the second antenna. The second antenna further includes a second antenna radiating element, a ground conductor, a second coupler and a feed. The second coupler includes a first signal conductor and a second signal conductor. The first signal conductor of the second coupler is coupled to the second antenna radiating element, and the second signal conductor of the second coupler is coupled to the ground conductor. The principal plane of the second antenna 240 extends in the Z and Y directions.

In an example of the first variant of the first embodiment of the antenna system and much as is described with respect to the antenna depicted in FIG. 5, the plural antennas further include a third antenna, and the third antenna 250 includes a third insulating substrate extending in a principal plane of the third antenna. The third antenna further includes a third coupler having first and second signal conductors. The third antenna further includes a wire wound in plural turns around the third insulating substrate and having a first end coupled to the second signal conductor. The third antenna further includes a tap conductor coupled between the first signal conductor and a predetermined one of the plural turns of the wire. The principal plane of the third antenna 250 extends in the Z and Y directions.

In a first mechanization, the principal planes of the first and third antennas 230, 250 are oblique; and possibly substantially orthogonal.

In an example of the first mechanization, the principal planes of the second and third antennas 240, 250 are substantially parallel.

In a second mechanization, the principal planes of the second and third antennas 240, 250 are substantially parallel.

In a second variant of the first embodiment of the antenna system, the second antenna is located and oriented as antenna 250 in FIGS. 7-8. Much as is described with respect to the antenna depicted in FIG. 5, second antenna 250 includes a planar shaped second insulating substrate extending in the principal plane of the second antenna. The second antenna further includes a second coupler having first and second signal conductors. The second antenna further includes a wire wound in plural turns around the second insulating substrate and having a first end coupled to the second signal conductor. The second antenna further includes a tap conductor coupled between the first signal conductor and a predetermined one of the plural turns of the wire. The principal plane of the second antenna 250 extends in the Z and Y directions.

In a second embodiment of an antenna system, the antenna system includes plural antennas. Each antenna is different than every other antenna, and each antenna is characterized by a principal plane. A principal plane of a first antenna is substantially parallel to a principal plane of a second antenna 240. Much as is described with respect to the antenna depicted in FIG. 4, the second antenna 240 includes a planar shaped insulating substrate extending in the principal plane of the second antenna and having an obverse side. The second antenna further includes a radiating element and a ground conductor disposed on the obverse side, a coupler having first and second signal conductors and a feed disposed on the obverse side. The first signal conductor is coupled to the radiating element, and the second signal conductor is coupled to the ground conductor.

In a first variant of the second embodiment of the antenna system, the first antenna is located and oriented as antenna 250 in FIGS. 7-8. Much as is described with respect to the antenna depicted in FIG. 5, first antenna 250 includes a planar shaped first insulating substrate extending in the principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In a third embodiment of an antenna system, the antenna system includes plural antennas. Each antenna is different than every other antenna, and each antenna is characterized by a principal plane. A principal plane of a first antenna 250 is oblique to a principal plane of a second antenna. The second antenna may be located and oriented as depicted by antenna 230 in FIGS. 7-8 or other locations. Much as is described with respect to the antenna depicted in FIG. 5, the first antenna 250 includes a first insulating substrate extending in a principal plane of the first antenna. The first antenna further includes a first coupler having first and second signal conductors. The first antenna further includes a wire wound in plural turns around the first insulating substrate and having a first end coupled to the first signal conductor. The first antenna further includes a tap conductor coupled between the second signal conductor and a predetermined one of the plural turns of the wire.

In many variants of the above embodiments, antennas designed substantially similarly to the antenna depicted in FIGS. 1-3, are designed to operate near resonance over a frequency range from 400 MHz to 500 MHz. This band covers an important FRS band at 462 MHz and another band at 434 MHz.

In many variants of the above embodiments, antennas designed substantially similarly to the antenna depicted at 60 in FIG. 4, are designed to operate near resonance over a frequency range from 462 MHz to 474 MHz. This band covers an important FRS band at 462 MHz and another bands at 474 MHz.

In many variants of the above embodiments, antennas designed substantially similarly to the antenna depicted at 80 in FIG. 4, are designed to operate near resonance over a frequency range from 1,800 MHz to 1,900 MHz. This band covers important cell phone bands.

In many variants of the above embodiments, antennas designed substantially similarly to the antenna depicted at 82 in FIG. 4, are designed to operate near resonance over a frequency range from 800 MHz to 900 MHz. This band covers important cell phone bands.

In many variants of the above embodiments, antennas designed substantially similarly to the antenna depicted at 84 in FIG. 4, are designed to operate near resonance over a frequency range from 2,400 MHz to 2,500 MHz. This band covers important cell phone bands.

In many variants of the above embodiments, antennas designed substantially similarly to the antenna depicted in FIG. 5, are designed to operate near resonance over a frequency range from 25 MHz to 200 MHz. This band covers an important data links at 27 MHz and 134 MHz to 138 MHz.

In a jammer operation, the antennas are fed by signal oscillators. While known broadband jammers require noise generators, with the present invention, inexpensive oscillators may be used. It should be noted that spectral purity of the oscillator is not a requirement. Waveforms distorted from pure sinusoidal waveforms merely add to the broadband coverage. The several antennas, located in the near radiation field (i.e., within 5 to 10 wavelengths) from each other, add to the distortion giving rise to a broadband effect. Signals radiated from one antenna excite parasitic resonance in other nearby antennas. The oscillators for a frequency range from 400 MHz to 500 MHz, for a frequency range from 800 MHz to 900 MHz, for a frequency range from 1,800 MHz to 1,900 MHz, and for a frequency range from 2,400 MHz to 2,500 MHz are located in electronic module 226 of FIG. 8. The oscillators for a frequency range from 25 MHz to 200 MHz and for 300 MHz to 500 MHz are located in electronic module 224. Other locations may be equivalent, but the system performance must be checked to ensure proper performance.

The overall antenna system is intended to work with the oscillators to disrupt communications in selected bands. When considering design balancing, the need for portable operation and long battery life gives rise to a need for low transmit power. However, high transmit power is generally needed to jam a data link. Long battery life is best achieved by ensuring that the radiation intensity pattern is efficiently used. Coverage for the system described is intended to be omni directional in three dimensions. Thus, the best antenna pattern is achieved when there are no main lobes with great antenna gain and no notches with below normal antenna gain. For at least this reason, placement of the antennas and all conductive elements (e.g., electronic modules 224 and 226) are very important, a requirement that become all the more difficult when another requirement of broadband jamming is required in selected bands.

Figure 9:
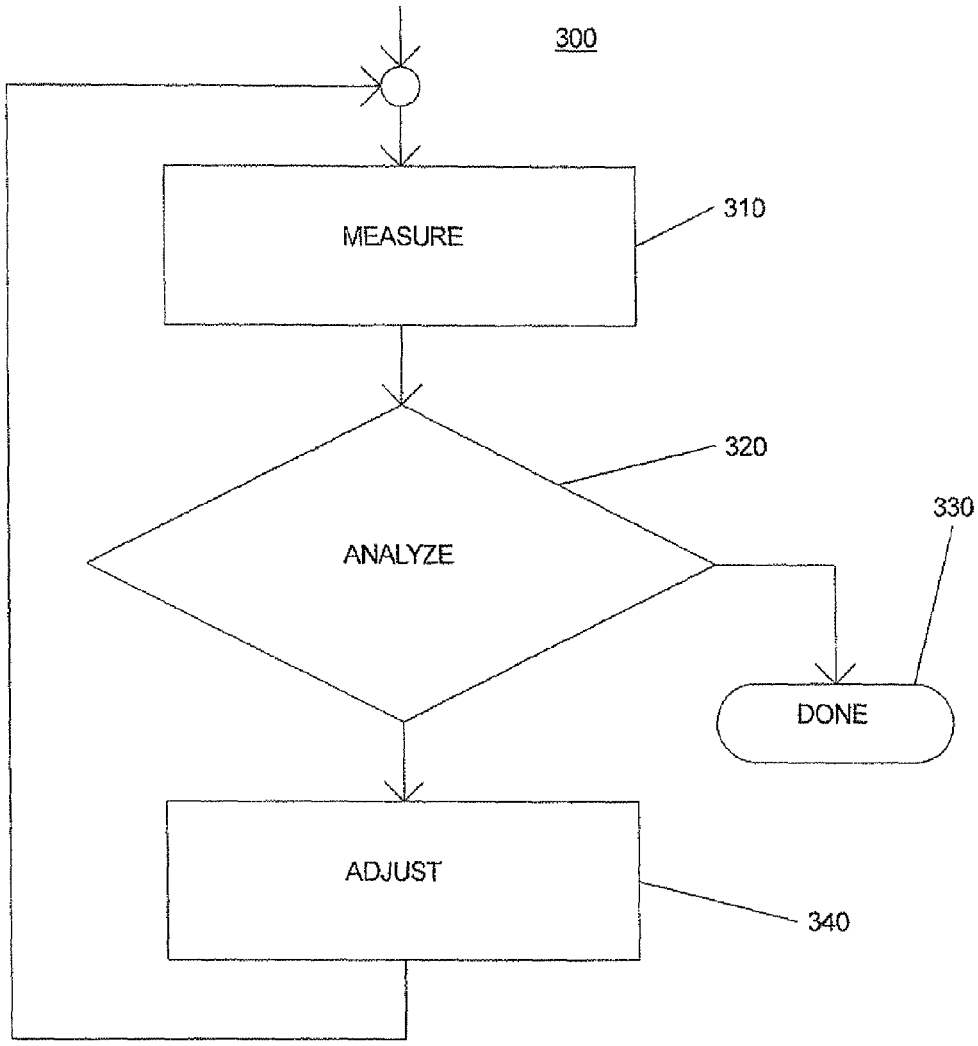
FIG. 9 is a flow chart of an embodiment of a process to tune an antenna system.

To meet these stringent requirements, the design process 300 includes measuring performance, analyzing the results and adjusting the antennas' location, orientation and individual antenna design. In FIG. 9, the performance is measured at 310. The performance is measured in terms of antenna gain at angular intervals over an entire unit sphere. At each angular measurement point, the gain is measured at each frequency of interest for the design. The measured performance is analyzed at 320. If the gain is adequate at each angular position and at each frequency of interest, then the design is correctly adjusted and the design process is done at 330. If the performance is inadequate at either a spatial point or at a spectral point (i.e., a frequency point), then the design is adjusted at 340.

Figure 10:
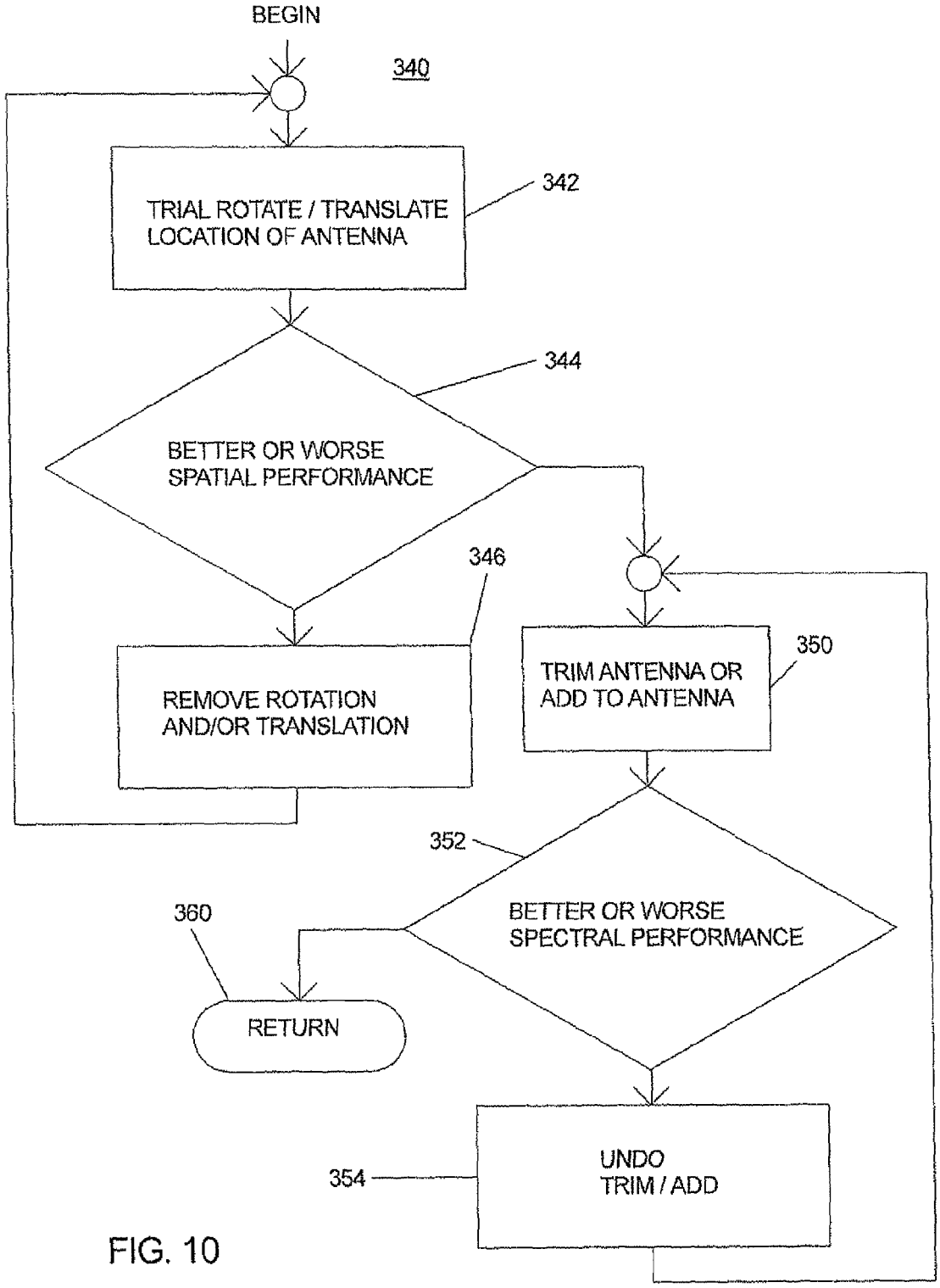
FIG. 10 is a flow chart of an embodiment of the adjust process of FIG. 9.

In FIG. 10, the design adjustment process 340 is depicted. If the gain is inadequate at a spatial point, a trial relocation or rotation of an antenna is attempted 342. The performance is measured and a decision is made at 344 as to whether the spatial performance (i.e., antenna pattern) is better or worse. If the spatial performance is worse, the rotation and/or translation is removed at 346 and a new try is made at 342. In this instance, better means that the spatial performance at one required frequency is met. If the performance is better as tested at 344, then the antennas are adjusted. Beginning with the antenna that has the best performance as measured by gain uniformity over the frequency band, the antenna is adjusted at 350 by trimming the size of the antenna or adding to the size of the antenna. Typically, this is done by trimming a copper clad epoxy-glass substrate with a sharp knife or by adding conductive foil to extend the size of the antenna. This process may be guided by known antenna design techniques. Once adjusted, the antenna is tested for spectral uniformity at 352, and if the uniformity requirement is not yet met, the trim/add is undone at 354 and the adjusting of the antenna is done again. After one antenna is adjusted, the next antenna in the antenna system is similarly adjusted until all antennas provide a suitable uniform spectral response, at which time, the adjustment process 340 is done at 360.

In FIG. 9, after the adjustment process 340 is completed a new measurement is made at 310 and analyzed at 320. This process is repeated until done at 330.

Figure 11:
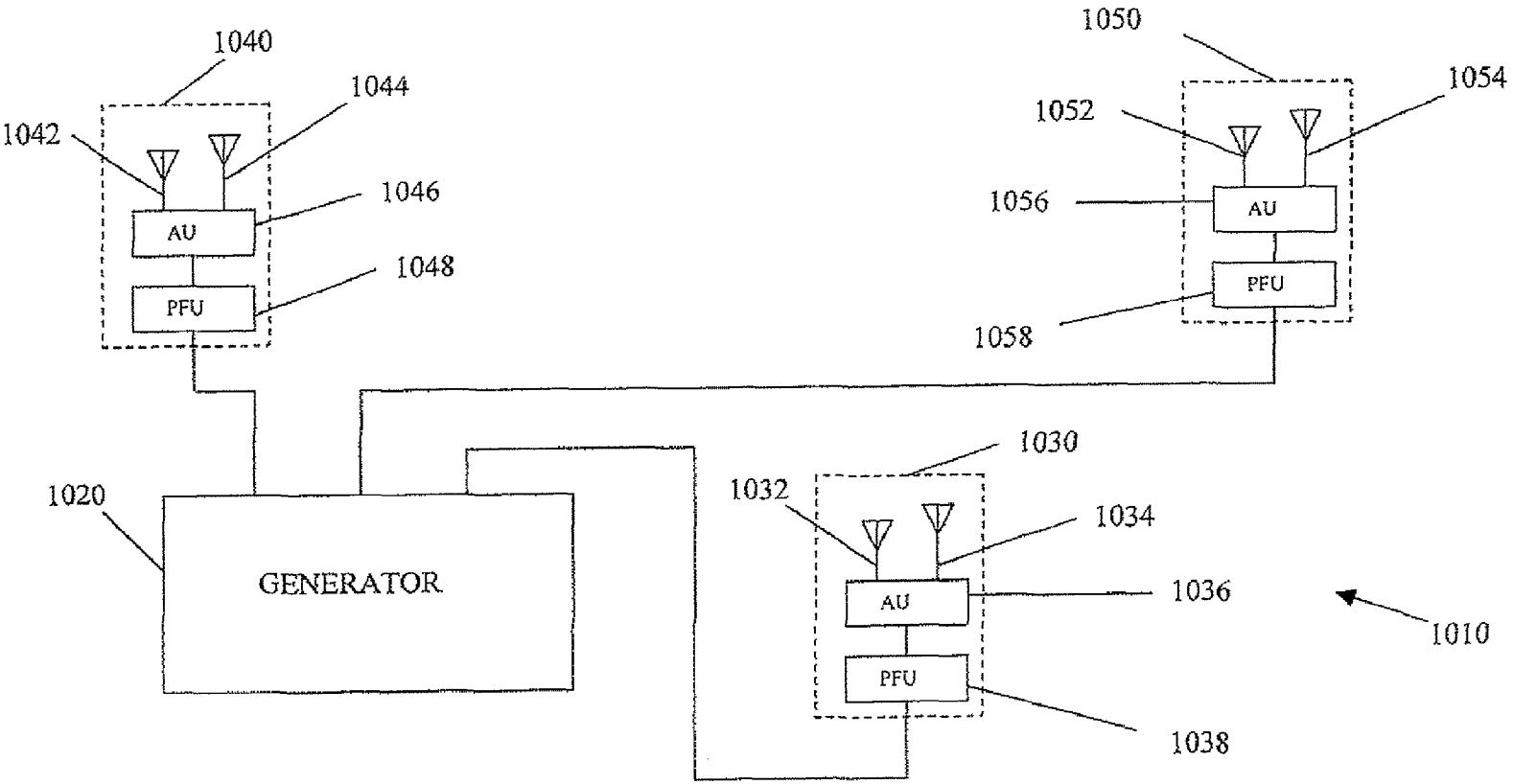
FIG. 11 is a block diagram of a jamming system according to an embodiment of the invention.

Another embodiment of a jamming system is depicted in FIG. 11, where a system 1010 includes a generator 1020 and at least three devices 1030, 1040 and 1050. System 1010 may advantageously be included within the electronic modules contained in antenna system 200 of FIGS. 7 and 8. A first device 1030 includes a receive antenna 1032, a transmit antenna 1034, an antenna unit 1036 and a programmable feed unit 1038 coupled between antenna unit 1036 and generator 1020. A second device 1040 is similarly configured, and a third device 1050 is similarly configured. In each device, a signal received at the receive antenna is amplified and broadcasted from the transmit antenna so that the device itself oscillates and produces a random noise signal. In an alternative embodiment of the invention, the system further includes one or more addition devices similar to devices 1030, 1040 and 1050.

Figure 12:
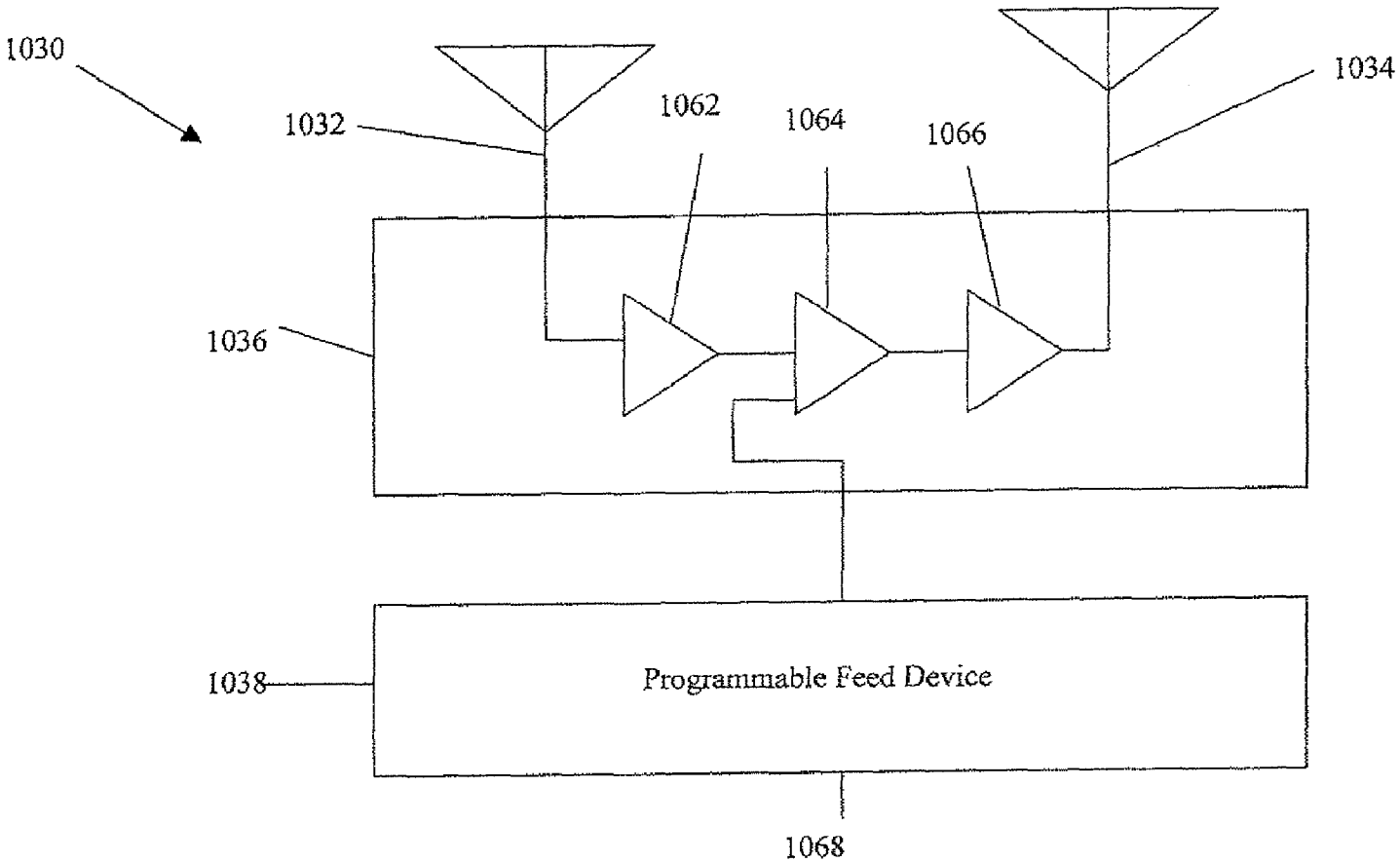
FIG. 12 is a block diagram of a device showing details of an embodiment of an antenna unit.

In a variant of the embodiment and as depicted in FIG. 12, each antenna unit 1036, 1046 and 1056 in each device 1030, 1040 and 1050 includes a receiver 1062 coupled to the respective receive antenna, a controllable amplifier 1064 coupled to the respective receiver and also coupled to the respective programmable feed unit 1038, 1048 and 1058, and a transmitter 1066 coupled between the respective amplifier and the respective transmit antenna 1034, 1044 and 1054. As discussed below, signal 1068 is to be regarded as a bundle of signals provided by generator 1020 to the programmable feed unit, and signal 1068 may include any of:

1. an RF signal from generator 1020 to the programmable feed unit;
2. a signal to control phase shifting of the RF signal in either the programmable feed unit or in the controllable amplifier of the antenna unit or both; and
3. a signal to control attenuation of the RF signal in either the programmable feed unit or in the controllable amplifier of the antenna unit or both.

The phase shifted and/or attenuated version of the RF signal is then provided by the programmable feed unit to control the controllable amplifier 1064 in the receiver unit. This ensures random noise is produced from the transmit antenna.

In operation, each device tends to oscillate on its own. A signal from the transmit antenna is picked up on the receive antenna. The signal picked up on the receive antenna is received in receiver 1062, amplified in amplifier 1064 and provided to transmitter 1066 that is coupled the respective transmit antenna. When this loop provides enough gain, the device will oscillate. In fact, the proximity of the antennas helps ensure that the loop will have enough gain. Amplifier 1064 may well provide fractional amplification or operate as an attenuator. This loop is adjusted to have a loop gain from just below oscillation to just above oscillation when operated on its own. The receive antenna will pick up additional signals from other transmit antennas in system 1010 and from reflections off nearby reflective surfaces. In addition, signals from the respective programmable feed device 1038, 1048 or 1058, as discussed herein, are added into the loop at amplifier 1064. The loop gain is adjusted to oscillate with a random noisy waveform in this environment.

In another variant of the embodiment, the generator produces a signal that is characterized by a center frequency. The generator includes a comb generator with a bandwidth greater than 20% of the center frequency and preferably greater than 50% of the center frequency.

In practical systems, jamming of signals at frequencies of 312, 314, 316, 392, 398, 430, 433, 434 and 450 to 500 MHz may be desired. A center frequency of 400 MHz and a jamming bandwidth of 200 MHz (307 MHz to 507 MHz, a 50% bandwidth) would cover this range. A very suitable system for some application may be realized by jamming 430 through 500 MHz (a 20% bandwidth centered on 460 MHz). The frequency band from 312 through 316 MHz may be easily covered by a 2% bandwidth generator, and the 392 and 398 MHz frequencies may be easily covered by a generator with just a little more than 2% bandwidth.

In another variant of the first embodiment, the programmable feed unit in each device includes either a programmable attenuator coupled to the generator, a programmable phase shifter coupled to the generator, or both. In a version of this variant, where the programmable feed unit in each device includes the programmable attenuator, the programmable attenuator includes a variable gain amplifier characterized by a gain controlled by a signal from the generator. In another version of this variant, where the programmable feed unit in each device includes the programmable phase shifter, the programmable phase shifter may be mechanized with several designs.

In one design, the programmable phase shifter includes a network that includes a variable inductor where an inductance of the inductor is controlled by a signal from the generator. An example of such a variable inductor is a saturable inductor. A saturable inductor might include two coils wound around a common magnetic material such as a ferrite core. Through one coil, a bias current passes to bring the ferrite core in and out of saturation. The other coil is the inductor whose inductance is varied according to the bias current. The bias current is generated in generator 1020, and it may be either a fix bias to set the phase shifting property or it may be a pulsed waveform to vary the phase shifting property.

In another design, the programmable phase shifter includes a network that includes a variable capacitor where a capacitance of the capacitor is controlled by a signal from the generator. A back biased varactor diode is an example of such a variable capacitor.

In yet another design, the programmable phase shifter includes a variable delay line where a delay of the delay line is controlled by a signal from the generator. A typical example of this type of delay line at microwave frequencies is a strip line disposed between blocks of ferrite material where the blocks of ferrite material are encircled by coils carrying a bias current so that the ferrite materials are subjected to a magnetizing force. In this way, the propagation properties of strip line are varied according to the magnetizing force imposed by the current through the coil.

In yet another design, the programmable phase shifter includes two or more delay lines, each characterized by a different delay. The phase shifter further includes a switch to select an active delay line, from among the two or more delay lines, according to a signal from the generator.

Whatever the design that is used, the bias current or control signal is generated in generator 1020. It may be either a fixed voltage or current to set the phase shifting property of the programmable feed unit or it may be a pulsed waveform to vary the phase shifting property.

In another variant of the embodiment, generator 1020 is processor controlled. The processor may be a microprocessor or other processor. A memory stores the modes of operations in the form of a threat table that specifies such parameters as the center frequency and the bandwidth of the signals to be generated by generator 1020 for each threat or application and stores the attenuation and phase shifting properties to be provided to each of the programmable feed units 1038, 1048 and 1058. In a typical generator design, the threat table provides a center frequency for a radio frequency jamming signal and also proved a seed for a random number generator (e.g., digital key stream generator). The random numbers are used to generate a randomly chopped binary output waveform at about 5 to 20 times the center frequency that is used as a chopping signal to modulate the signal at the center frequency. Many other types of noise generators may also be used. The output of the chopped center frequency signal is a broadband noise signal that is provided to each of the programmable feed units 1038, 1048 and 1058.

In alternative variants, generator 1020 includes circuits to generate additional randomly chopped binary output waveforms, according to parameters in the threat table, to control the variable attenuator and/or the variable phase shifter in each of the programmable feed units 1038, 1048 and 1058. Alternatively, the threat table may store a fixed number, for each threat, to provide a fixed attenuation and a fixed phase shift in the programmable feed units 1038, 1048 and 1058 that may be selected differently for each threat.

Figure 13:
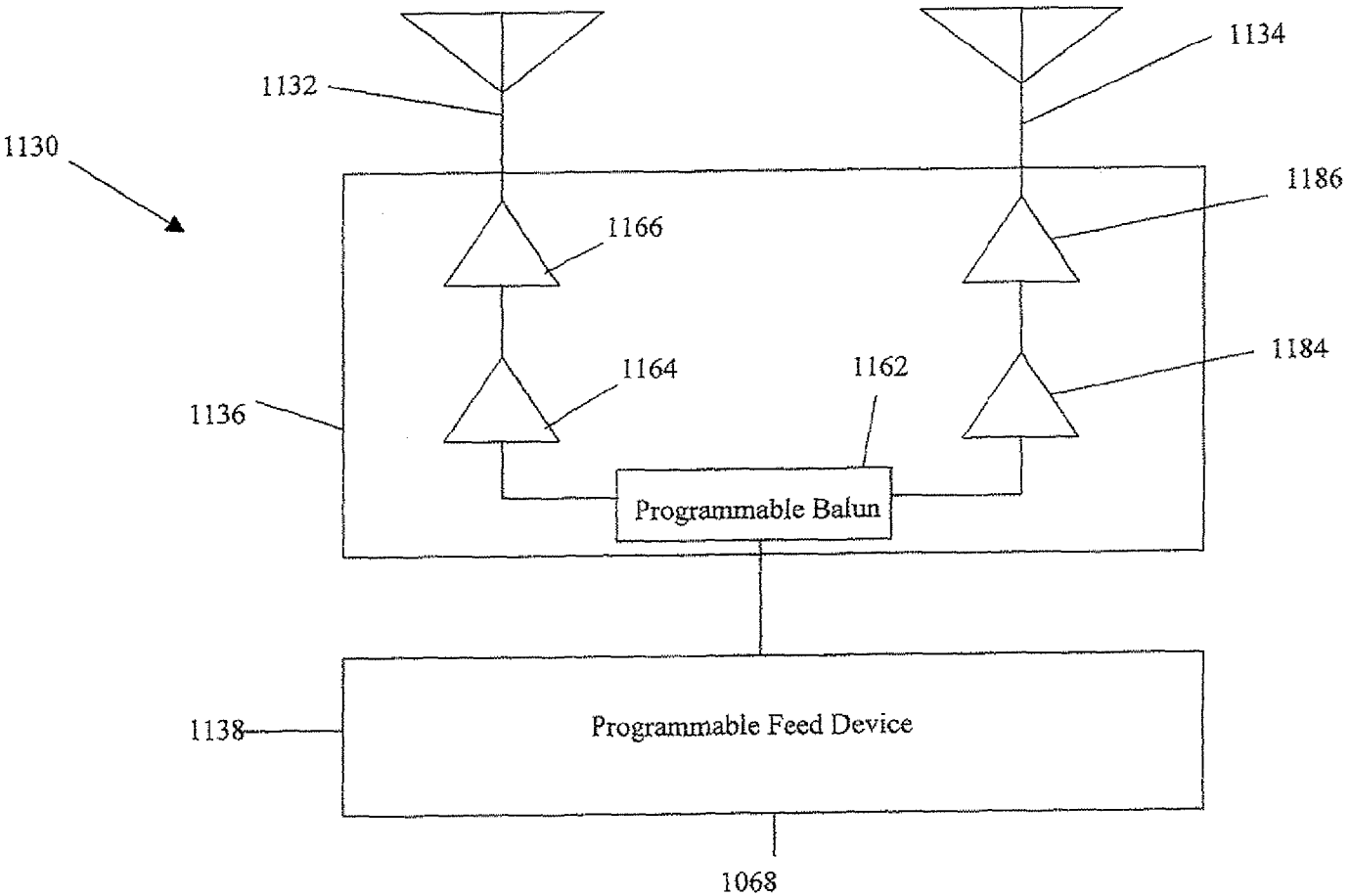
FIG. 13 is a block diagram of a device showing details of an embodiment of another antenna unit.

In yet another variant of the embodiment and as depicted in FIG. 13, one or more of devices 1030, 1040 and 1050 (of FIG. 11) are replaced by a driven device 1130 depicted in FIG. 13. Driven device 1130 of FIG. 13 includes a programmable feed device 1138 similar to programmable feed device 1038 of FIG. 12, and driven device 1130 includes an antenna unit 1136 all together different than antenna unit 1036 of FIG. 12. Antenna unit 1136 is a circularly polarized driven antenna unit that operates differently from the parasitically oscillating function of the antenna unit 1036 of FIG. 12.

Antenna unit 1136 of driven device 1130 includes a programmable balun 1162 coupled to receive an RF signal from programmable feed device 1138 and functioning to split the signal from feed device 1138 into two phase diverse signals to drive respective controllable amplifiers 1164, 1184. The respective amplified signals, call them left and right amplified signals, out of respective controllable amplifiers 1164 and 1184 feed respective transmitters 1166 and 1186. The left and right transmit signals out of respective transmitters 1166 and 1186 are coupled to respective left and right transmit antennas 1132 and 1134. Right transmit antenna 1134 may be the same or similar to transmit antenna 1034 of FIG. 12. Left transmit antenna 1132 may be the same or similar to receive antenna 1032 of FIG. 12, except that it is driven by left transmitter 1166 instead of being coupled to receiver 1062 of FIG. 12.

As discussed above with respect to FIG. 12, signal 1068 is provided by generator 1020 to the programmable feed unit to provide an RF signal and control signals, and signal 1068 includes:

1. a signal to control phase shifting of the RF signal in the programmable feed unit as discussed below;
2. a signal to control attenuation of the RF signal; and
3. an RF signal from generator 1020 to the programmable feed unit; however, the RF signal from generator 1020 will be modulated upon a sweeping RF carrier signal as distinguished from the device depicted in FIG. 12.

Balun 1132 is a signal splitter that outputs to controllable amplifiers 1164, 1184 signals distinguished by phase. If the phase difference were 90 degrees and the phase centers of the antennas 1132, 1134 were coincident, the result would be a circular polarized wave originating at the antenna phase center. However, the antenna phase centers are separated by a distance and the actual phase difference between the outputs of the balun is controlled by the signal to control phase shifting of the RF signal that is part of the signals provided in signal 1068. In fact, the generator may advantageously provide a randomly varying signal to control phase shifting of the RF signal. This random variation provides greater distortion observable at any point within the area of protection.

The signal to control attenuation of the RF signal that is part of the signals provided in signal 1068 may control the gain and/or attenuation of the RF signal as it passes through programmable feed unit 1138. Alternatively, the signal to control attenuation of the RF signal that is part of the signals provided in signal 1068 may advantageously include two separately controllable gain/attenuation control signals that pass through programmable feed unit 1138, are split by balun 1132 so that individual and separately controllable gain/attenuation control signals are coupled to control respective controllable amplifiers 1164 and 1184.

Unlike device 1030 discussed above with respect to FIG. 12, driven device 1130 discussed with respect to FIG. 13 does not parasitically oscillate at desired target frequencies. Instead, generator 1020 provides the RF signal that is part of the signals provided in signal 1068 already modulated upon a desired RF carrier signal.

Figure 14:
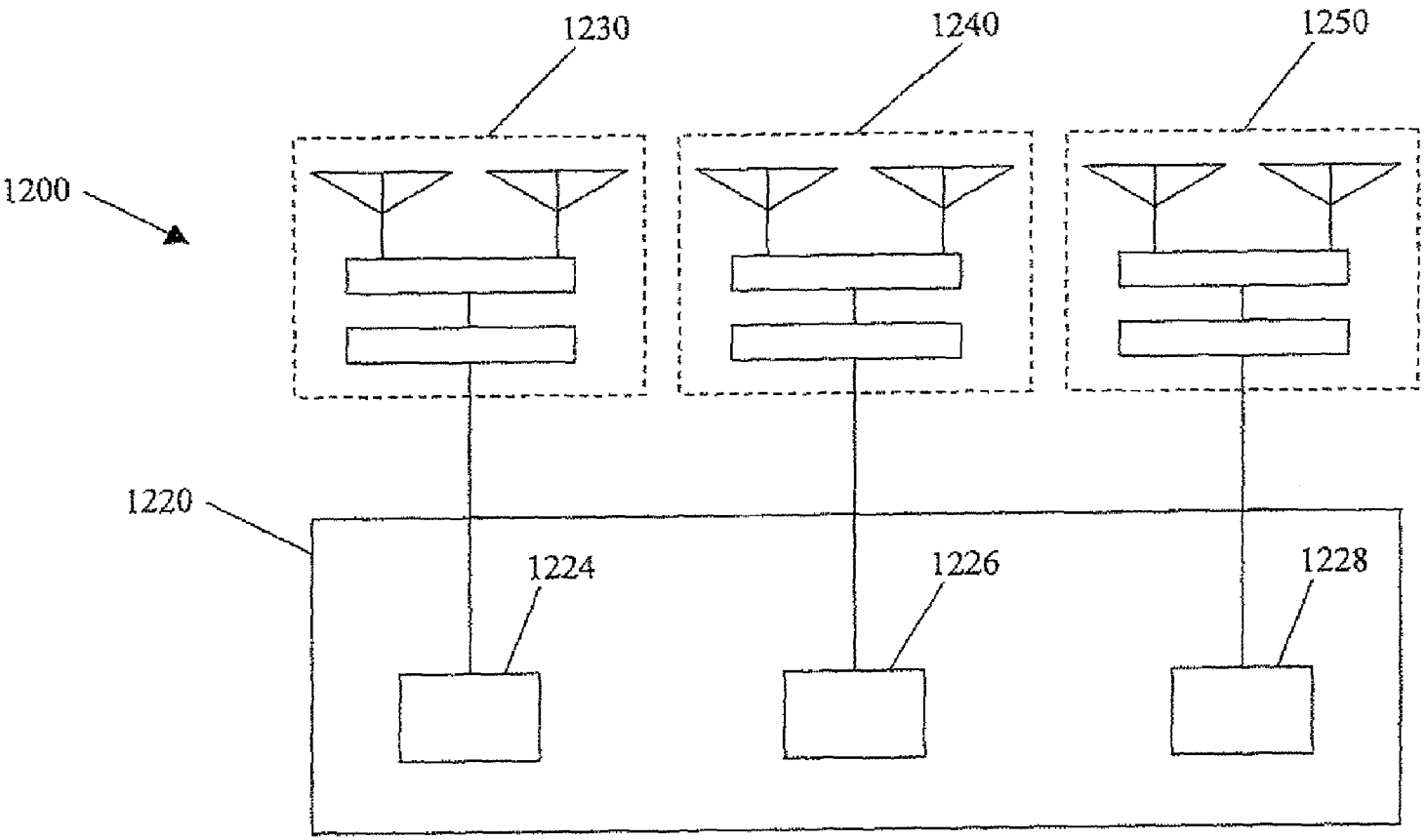
FIG. 14 is a block diagram of a system showing details of an embodiment of a generator.

In FIG. 14, jamming system 1200 includes generator 1220 and three driven devices 1230, 1240, 1250 of the type described with respect to FIG. 13. Generator 1220 includes three band specific modulators 1224, 1226, 1228.

Typically, generator 1220 is processor controlled. The processor may be a microprocessor or other processor. A memory stores the modes of operations in the form of a threat table that specifies such parameters as the center frequency and the bandwidth (or the frequency minimum and the frequency maximum) of the signals to be generated by generator 1220 for each threat or application and stores the attenuation and phase shifting properties to be provided to each of the programmable feed units within driven devices 1230, 1240 and 1250. The center frequency and bandwidth (or the frequency minimum and the frequency maximum) for each threat is provided to respective ones of modulators 1224, 1226 and 1228 to generate desired frequencies, and the outputs of modulators 1224, 1226 and 1228 are provided to respective ones of driven devices 1230, 1240 and 1250 as the signal carried within the bundle of signals discussed above as signal 1068. The processor, memory and the phase and amplitude control signals discussed above are not depicted in FIG. 14 for clarity.

In alternative variants, generator 1220 may include circuits to generate randomly varying attenuation and phase shift, or may include circuits to generate fixed attenuation and phase shift, according to parameters in the threat table, to control the variable attenuator and/or the variable phase shifter in each of the programmable feed units 1038, 1048 and 1058 of driven devices 1230, 1240 and 1250 that may be selected differently for each threat.

Figure 15:
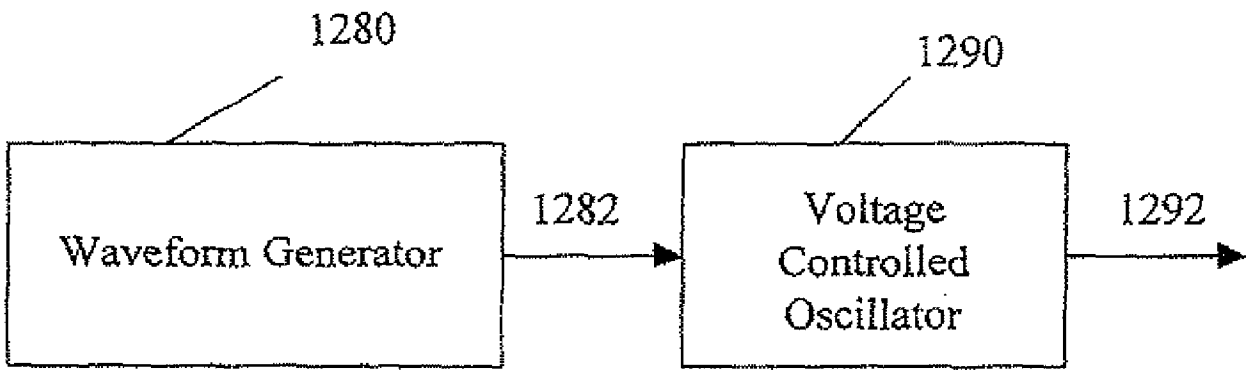
FIG. 15 is a block diagram of details of a waveform oscillator according to an embodiment of the invention.

FIG. 15 depicts an example of a representative modulator of band specific modulators 1224, 1226, 1228. In FIG. 15, a waveform generator 1280 provides waveform signal 1282 coupled to voltage controlled oscillator 1290 (VCO 1290). VCO 1290 converts waveform signal 1282 into frequency modulated waveform signal 1292 that is contained in the bundle of signals 1068 (FIG. 12).

Figure 16:
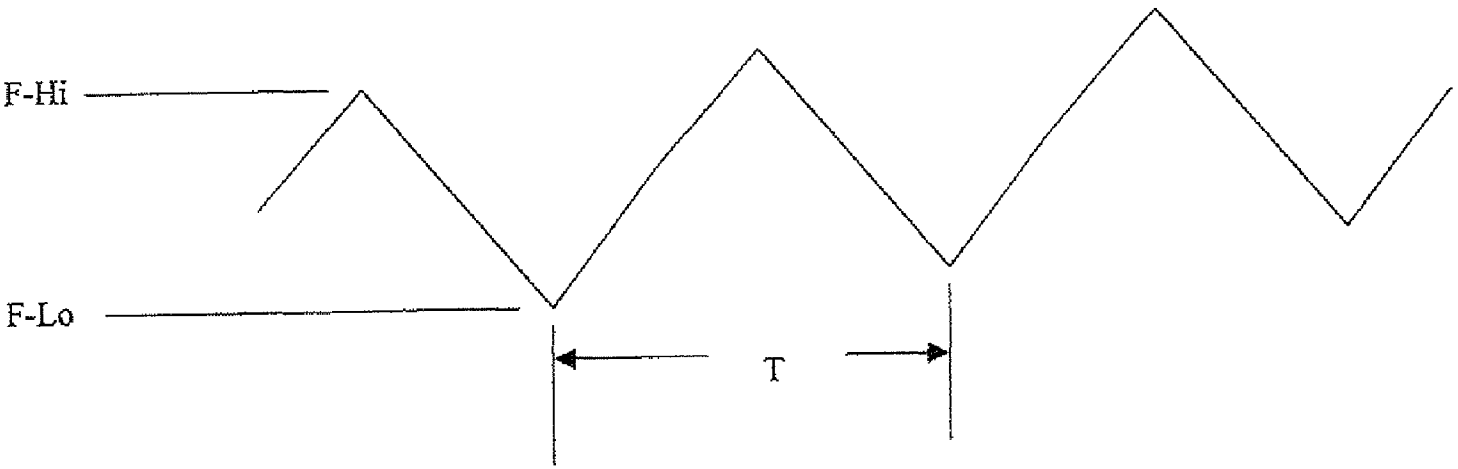
FIG. 16 is a waveform diagram showing a representative waveform produced by the waveform oscillator.

Typically, waveform generator 1220 is processor controlled. The processor may be a microprocessor or other processor. A memory stores the modes of operations, typically in the form of a threat table that specifies such parameters as the frequency minimum and the frequency maximum (or the center frequency and the bandwidth) of the signals to be generated by each of the band specific modulators 1224, 1226, 1228. For example, the memory might store low frequency F-Lo and high frequency F-Hi values to generate the waveform depicted in FIG. 16. The memory also stores either the period T (see FIG. 16) or perhaps the time for a raising frequency T-Rise and the time for a falling frequency T-Fall.

In addition, the memory preferably stores the attenuation and phase shifting properties to be provided to each of the programmable feed units within driven devices 1230, 1240 and 1250. The values for these attenuation and phase shifting properties are retrieved from the memory and provided either in digital form, or converted to analog form, to control the variable attenuator and/or the variable phase shifter in each of the programmable feed units 1038, 1048 and 1058 of driven devices 1230, 1240 and 1250 as a signal contained in the bundle of signals 1068 (FIG. 12).

Each VCO 1290 in each of the several band is likely to have its own unique conversion relationship to convert the voltage in to frequency out. The threat table, or a separate resources calibration table, includes the parameters for an equation to convert each specific voltage to a specific frequency. Typically, when the conversion is linear as it is over reasonably narrow bandwidths, two parameters are required: an offset reference (e.g., $V_0$, $f_0$) and a slope (e.g., $\Delta V/\Delta f$). However, when a VCO is pushed to its limits, the conversion equation from voltage to frequency may include a third parameter for a quadratic factor. In any event, waveform generator 1280 provides the voltage as signal 1282 that is necessary for VCO 1290 to convert the voltage to a desired frequency modulated waveform signal 1292, for example covering the desired band in a triangle waveform depicted in FIG. 16.

Frequency modulated waveform signal 1292 varies from a low frequency end of the band, F-Lo, to a high frequency end of the band, F-Hi. The triangle wave repeats on a cycle with a period T. Testing has revealed that the triangle waveform is superior for disrupting communication signals when compared to a frequency stepped waveform. As an example, the repeat period of the triangle waveform, a period T, is preferably about 1.5 milliseconds when F-Lo is 3 MHz and F-Hi is 500 MHz.

Figure 17:
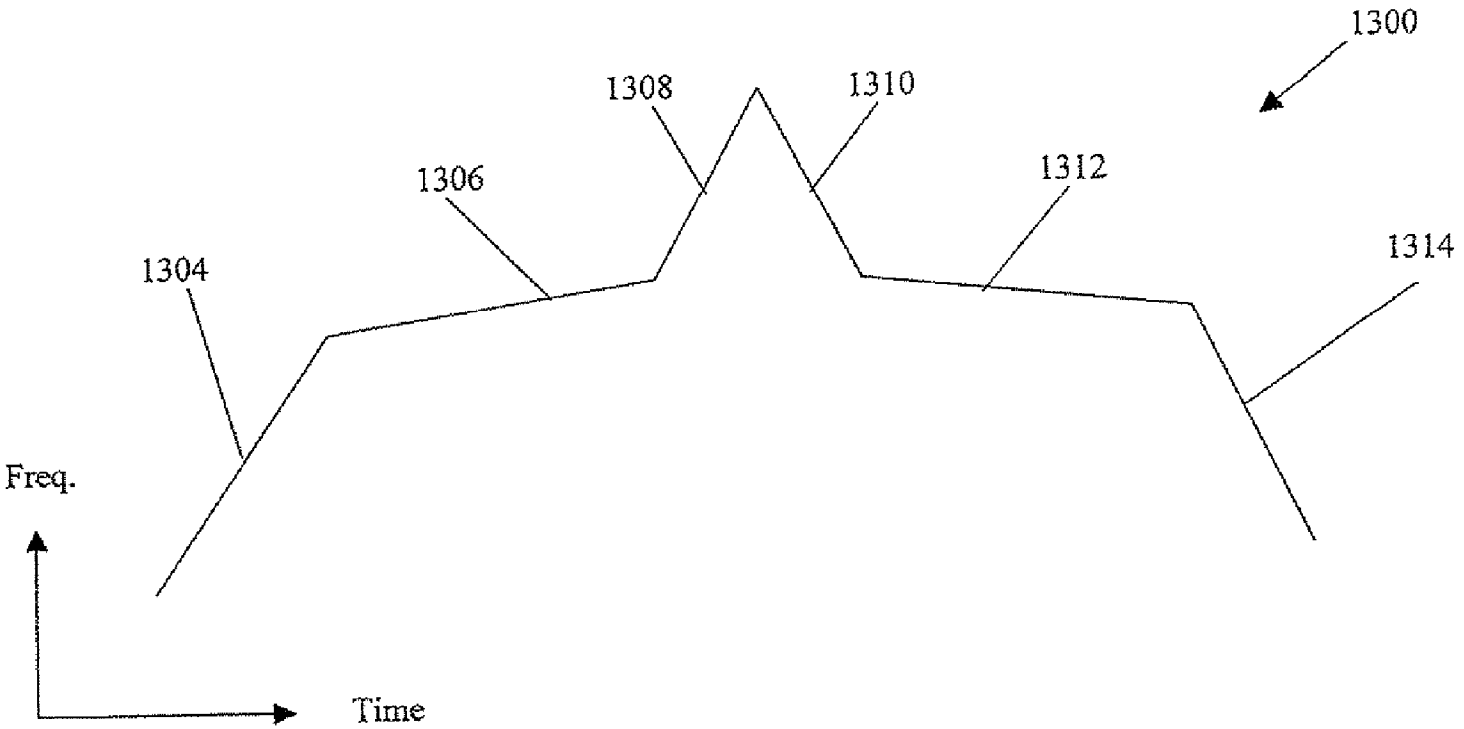
FIG. 17 is a waveform diagram showing an alternative representative waveform produced by the waveform oscillator.

In yet another embodiment, frequency modulated waveform signal 1292 is caused to dwell for a longer period at a particular frequency to address an important threat within the band of any one of the band specific modulators 1224, 1226, 1228. In FIG. 17, there is depicted frequency modulated waveform signal 1300 that is comprised of six segments: 1304, 1306, 1308, 1310, 1312 and 1314. Segment 1304 has a relatively fast rise in frequency for a unit of time when compared to segment 1306 that has a comparatively slower rise in frequency for the same unit of time. Then, segment 1308 resumes the relatively fast rise in frequency per unit of time that characterizes segment 1304. Segments 1310, 1312 and 1314 are mirror symmetric conjugates of segments 1308, 1306 and 1304 respectively. This frequency modulated waveform signal 1300 is repeated at a desired predetermined rate. A representative threat table with only the scanning parameters is depicted in Table 1.

TABLE 1

| Segment No. | Start Freq. | Stop Freq. | Segment Time | Next Segment |
|---|---|---|---|---|
| 1 | 3 MHz | 315 MHz | .45 milliseconds | 2 |
| 2 | 315 MHz | 320 MHz | .05 milliseconds | 3 |
| 3 | 320 MHz | 400 MHz | .25 milliseconds | 4 |
| 4 | 400 MHz | 320 MHz | .25 milliseconds | 5 |
| 5 | 320 MHz | 315 MHz | .05 milliseconds | 6 |
| 6 | 315 MHz | 3 MHz | .45 milliseconds | 1 |

In the frequency band of segments 1 and 6, frequencies are scanned at a rate of 693 MHz per millisecond. In the frequency band of segments 2 and 5, frequencies are scanned at a rate of 100 MHz per millisecond. In the frequency band of segments 3 and 4, frequencies are scanned at a rate of 320 MHz per millisecond. Therefore, it can be seen that the frequency segment from 315 to 320 MHz is scanned at a slower rate, seems to dwell on these segments, than the other segments. It can now be seen that frequency modulated waveform signal 1292 can be customized by selecting parameters for Table 1 so that any one segment, or multiple segments, may be dwelled on when threats in those frequency ranges are anticipated. After the scan of one segment is complete, the next segment as indicated in Table 1 is begun. Table 1 is exemplary only and could be enlarged to include additional frequency segments. Typically, the threat table includes Table 1 plus stored values to control the variable attenuator and/or the variable phase shifter in the corresponding one of the programmable feed units 1038, 1048 and 1058 of driven devices 1230, 1240 and 1250.

The above described jamming system provides distorted signals to jam selected communications links. As a signal is radiated from one antenna, the signal is reflected or absorbed and re-radiated (i.e., scattered) from another antenna, even an out of band antenna. The proximity of the several antennas causes the scattering effects to multiply and form a more or less spherical radiation coverage pattern. Such a radiation jamming system may be mounted as an active unit on a vehicle and provide a bubble of protection around the vehicle.

In the active unit, the threat table is loaded based on recent intelligence about the communication links that needs to be jammed When the power levels associated with a particular communication link are such that more average power is needed to jam the link, the dwell time at or near the frequency of the particular communications link is extended relative to the repeat period of the entire waveform by designing a frequency segment as discussed above for an extended dwell.

In yet another embodiment, the several VCOs are designed to have a fast frequency slewing property sometimes called frequency settling time. When such slew rates are fast enough, the slope between two frequencies in FIG. 17 is near infinite. The slope of frequency segment 1304 appears steep in FIG. 17, but with faster slew rates, the slop would appear near infinite. When the slew rate is such that frequencies can change at in 10s of microseconds, single digit microseconds or even sub-microsecond intervals, frequency modulated waveform signal 1300 depicted in FIG. 17 can "jump" from one frequency to another. In this way, a particular threat that needs to be jammed (sometimes called "serviced") more often than the repeat period of the entire waveform signal 1300, can be "serviced" additional times during a single repeat period by "jumping" to a segment that dwells on the particular threat. For example, a particular threat in a very narrow sub-band of the band being jammed could be serviced 4 times, 6 times, 8 times or more during a single repeat period of waveform signal 1300 with a longer dwell (e.g., low slope of $\Delta S/\Delta t$) and by "jumping" to the frequency segment associated with that threat. All that is required is multiple entries in Table 1 for frequencies corresponding to the threat. The fast frequency slew rate will cause the depiction of the frequent servicing of the threat to appear as a discontinuous frequency when viewed on the scale of FIG. 17.

In yet another embodiment, a look through mode is implemented. In the look through mode, all transmitters are silenced, blocked or blanked using a blanking pulse of a predetermined blanking period, for example, 15 milliseconds. Transmitter 1066 (FIG. 12) and transmitters 1166 and 1186 (FIG. 13) of all antenna units are blanked during the blanking period. Frequency modulated waveform signal 1292 (FIG. 18) is passed to mixer 1294, preferably added to and configured in antenna unit 1036 (FIG. 12 or 13). Frequency modulated waveform signal 1292 sweeps in frequency between F-Lo and F-Hi in a periodic waveform (FIG. 16) or a more complex waveform (FIG. 17).

In this embodiment, mixer 1294 (FIG. 18) is incorporated into the programmable feed device 1038 of antenna unit 1036 (FIG. 12), and one of the mixer inputs is the output signal from controllable amplifier 1064 of antenna unit 1036. The other input to mixer 1294 is the frequency modulated waveform signal 1292 that is passed through the bundle of signals 1068 through to antenna unit 1036. The output of the mixer is baseband signal 1296 that is returned through another wire within the bundle of signals 1068 to baseband detector 1298.

In operation, signals on receive antenna 1032 pass through receiver 1062 and through controllable amplifier 1064 (see FIGS. 12 and 18) into one input of mixer 1294. Waveform signal 1292 provided by waveform generator 1280 and VCO 1290 is coupled to the other input of mixer 1294. Mixer 1294 provides both the sum and differences of the frequencies of the input signals; however, the sum signals are filtered out leaving the difference signals as baseband signal 1296. The sensitivity of the baseband detector relative to thermal noise (called signal to noise ratio) is a function of detector bandwidth. The baseband detector may advantageously have programmably selectable pre-filters to narrow the bandwidth detected (i.e., narrow the thermal noise and improve signal to noise ratio), and the waveform generator 1280 and VCO 1290 will frequency scan over a predetermined range from an F-Lo to an F-Hi to ensure coverage over the desired bandwidth. This is accomplished by proper design of Table 1 frequency segments.

If the antenna units are of a driven device design depicted in FIG. 13 instead of the parasitically oscillating devices depicted in FIG. 12, then transmitter 1086 must not only be blanked, but it must be open circuit isolated from antenna 1134. When isolated, antenna 1134 functions as a receive antenna (analogous to receive antenna 1032 in FIG. 12), and antenna 1134 is coupled through a receiver to a controllable amplifier (not shown in FIG. 13, but depicted in FIG. 17 as receiver 1062 and amplifier 1064). The output of the controllable amplifier is coupled to one input of mixer 1294 and processing proceeds as discussed above with respect to FIG. 18 using the parasitically oscillating devices depicted in FIG. 12.

Figure 18:
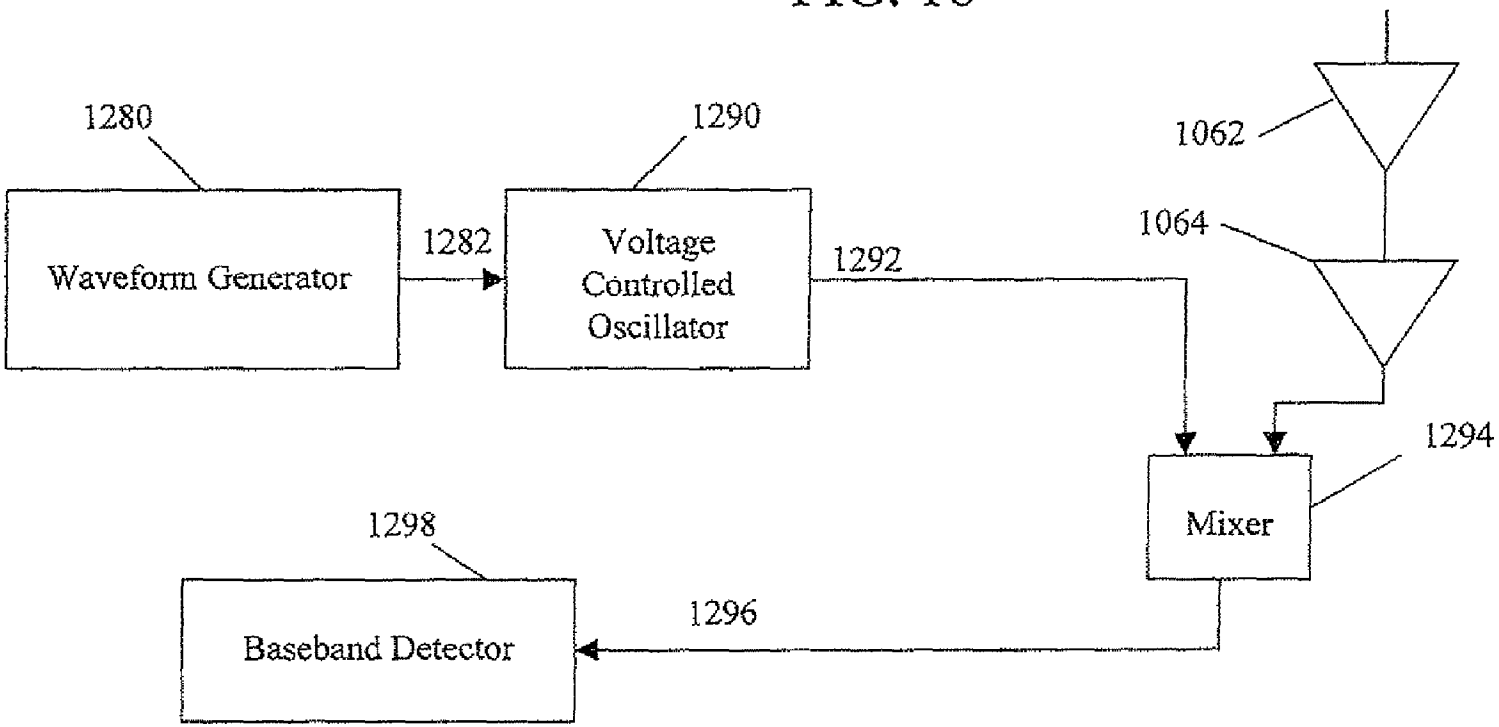
FIG. 18 is a block diagram of a system showing another embodiment of the invention.
Figure 19:
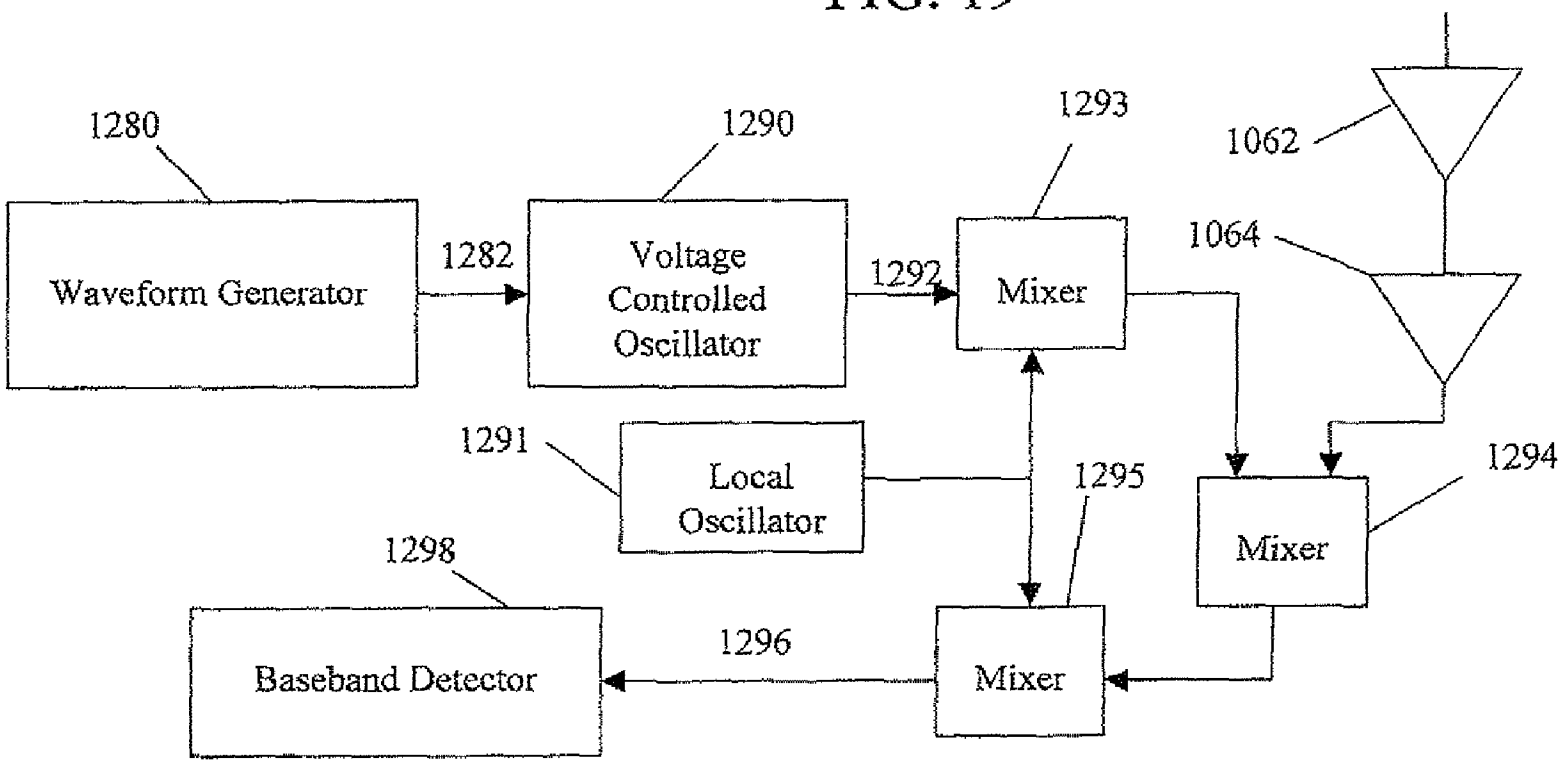
FIG. 19 is a block diagram of a system showing yet another embodiment of the invention.

In yet another embodiment is depicted in FIG. 19. The embodiment in FIG. 19 is nearly identical to the embodiment depicted in FIG. 18. However, in FIG. 19, frequency modulated waveform signal 1292 is heterodyned in mixer 1293 to be frequency shifted by the frequency of local oscillator 1291. The output of mixer 1293 is input into mixer 1294 instead of frequency modulated waveform signal 1292 as in the embodiment of FIG. 18. The output of mixer 1294 is heterodyned in mixer 1295 to be frequency shifted by the frequency of local oscillator 1291. The output of mixer 1295 is baseband signal 1296 that is input to baseband detector 1298.

In operation, frequency modulated waveform signal 1292 is frequency shifted (either up or down) by a frequency of an intermediate frequency, i.e., the frequency of local oscillator 1291. The output of mixer 1294 is the desired signal modulated on the intermediate frequency defined by the frequency of local oscillator 1291. If the intermediate frequency is carefully chosen (e.g., the IF of AM or FM audio radio receivers), the component and certainly the technology of these components are easily available. Then, mixer 1295 frequency shifts (either down or up, but the opposite of mixer 1293) by the intermediate frequency defined by local oscillator 1291 to deliver a baseband signal to baseband detector 1298.

Using the embodiment depicted in either FIG. 18 or 19, a reactive unit is achieved by periodically blanking all controlled transmitters (in either the reactive unit or any active units), and listening during the blanking pulse for any radiation to be jammed. The reactive unit includes the same jamming components discussed above with respect to the active unit plus components needed for a "sniff mode." Frequency scanning strategies used in this "sniff mode" are similar to the frequency scanning strategies discussed above with respect to Table 1. When the sniff mode blanking interval is complete, all received threats are prioritized, and a selected few threats (e.g., 3 or 4 threats) are identified for reactive jamming Reactive jamming is similar to active jamming programs discussed above with respect Table 1. However, reactive jamming concentrates on the selected few threats to be jammed and provides increased power density and "service" frequency to the frequency segments of selected few threats to be jammed.

In yet another embodiment, a reactive unit and an active unit are mounted on the same vehicle and coupled together with a tether through which the blanking pulse from the reactive unit is transmitted to the active unit in order to blank all transmitters in the active unit. The reactive unit continues reactive jamming, as discussed above, concentrated on the selected few threats to be jammed and providing increased power density and "service" frequency to the frequency segments of selected few threats to be jammed. The active unit continues active jamming programs, as discussed above with respect to Table 1, with the sole exception that the transmitters in the active unit are blanked during "sniff mode" of the reactive unit as indicated by the blanking pulse received over the tether. In this way, threats requiring higher power densities are serviced by the reactive unit when and if detected, but the active unit continues to jam all threats generally known to exist in the region of operation of the vehicle carrying the active and reactive units.

Having described preferred embodiments of a novel look through mode of a jamming system (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

What is claimed is:

1. A system for jamming radio frequency communications comprising:

a radio frequency generator for producing a radio frequency signal;

a transmit antenna for transmitting a radio frequency signal;

a receive antenna for receiving a radio frequency signal;

at least one an antenna unit, the antenna unit having a receiver having an input and an output, the input of the receiver coupled to the receive antenna, an amplifier having an input and an output, the input of the amplifier coupled to the output of the receiver, and a transmitter having an input and an output, the output of the transmitter coupled to the transmit antenna;

a signal mixer having inputs and an output, the output of the amplifier coupled to one of the inputs of the signal mixer and the output of the radio frequency generator physically coupled to another input of the signal mixer and the output of the radio frequency generator also coupled to the input of the amplifier;

a detector coupled to the output of the signal mixer for detecting a potential radio frequency threat signal; and a blanking pulse generator coupled to the transmitter for temporarily silencing or blanking the transmitter so that the transmitter does not output a signal to the transmit antenna.

2. A system according to claim 1, further including control circuitry coupled to the radio frequency generator and the blanking pulse generator and operable during a first predetermined time interval to cause the blanking pulse generator to prevent the transmitter from transmitting; and cause the radio frequency generator to provide a frequency swept radio frequency signal to the signal mixer.

3. A system according to claim 1, further including control circuitry coupled to the radio frequency generator and the blanking pulse generator and operable during a first predetermined time interval:

to cause the blanking pulse generator to prevent the transmitter from transmitting; and to cause the radio frequency generator to provide a radio frequency signal to the signal mixer that sweeps in frequency from a first predetermined frequency to a second predetermined frequency.

4. The system according to claim 1, wherein if a threat signal is detected by the detector, the radio frequency generator provides a signal to the transmit antenna to concentrate power density at a select frequency band.

5. The system according to claim 1, further including multiple devices having a transmit antenna and an amplifier, the multiple devices having multiple transmitters wherein the blanking pulse generator blanks all the transmitters simultaneously.

6. The system according to claim 1, wherein the transmitter is isolated from the transmit antenna when the transmitter is blanked or silenced by the blanking pulse generator.

7. The system according to claim 1, wherein the blanking pulse generator is coupled to the transmit antenna and switches the transmit antenna so that signals received from the transmit antenna are supplied to the receiver.

8. The system according to claim 1, further including prefilters to narrow the bandwidth provided to the detector.

9. The system according to claim 1, wherein the radio frequency generator produces a radio frequency signal characterized by a center frequency and includes a comb generator creating a band width greater than 20% of the center frequency.

10. The system according to claim 1, further comprising a programmable feed unit coupled between the antenna unit and the radio frequency generator, the amplifier coupled to the respective programmable feed unit.

11. The system according to claim 10, wherein the programmable feed unit includes a programmable attenuation coupled to the radio frequency generator, a programmable phase shifter coupled to the radio frequency generator or both.

12. The system according to claim 11, wherein the programmable phase shifter includes at least one of a variable inductor, a variable capacitor, a back biased varactor diode, and a variable delay line.

13. The system according to claim 1, wherein the radio frequency generator is processor controlled wherein a memory stores the modes of operation of the radio frequency generator in the form of a threat table that specifies the parameters to be generated by the radio frequency generator for each threat signal detected by the detector.

14. The system according to claim 13, wherein the processor has two parameters including an offset reference and a slope, wherein the offset reference includes a starting voltage or starting frequency at time zero, and wherein the slope includes a change in voltage or change in frequency over time.

15. The system according to claim 14, wherein the slew rate is such that the frequency-modulated signal can jump from one frequency to another frequency during the frequency sweep.

16. The system according to claim 1, wherein the output of the radio frequency generator includes a randomly chopped binary output wave form that is used as a chopping signal to modulate the signal.

17. The system according to claim 1, wherein the radio frequency generator provides a randomly varying signal to control phase shifting of the radio frequency signal.

18. The system according to claim 1, wherein the radio frequency generator provides the radio frequency signal modulated upon a desired carrier signal.

19. The system according to claim 1, wherein the processor controlled radio frequency generator stores the modes of operation as parameters that include the minimum frequency, the maximum frequency, and the time period for repeating the frequency sweep of the radio frequency generator.

20. The system according to claim 1, further including a driven device having a driven antenna unit and a programmable feed device, the driven antenna unit having at least two antennas for transmitting a radio frequency signal, at least two transmitters, each transmitter couplable to a respective one of the antennas, and at least two amplifiers, each amplifier couplable to a respective transmitter.

21. The system according to claim 20, wherein the antenna unit includes a programmable balun coupled to receive the radio frequency signal from the programmable feed device, the programmable balun functioning to split the radio frequency signal from the programmable feed device into at least two phase diverse signals to drive respective amplifiers.

22. The system according to claim 21, wherein two separately controllable attenuation control signals are split by programmable balun so that separate and controllable attenuation signals are coupled to respective first and second amplifiers.

23. The system according to claim 20, wherein the system includes at least three driven devices and the radio frequency generator includes at least three band specific modulators.

24. The system according to claim 23, wherein the band specific modulators include a waveform generator coupled to a voltage controlled oscillator.

25. The system according to claim 24, wherein the radio frequency generator is processor controlled and the waveform generator provides a signal as a voltage to the voltage controlled oscillator which converts the voltage to a predetermined frequency modulated waveform signal, and wherein the processor has a memory that stores the parameters to convert each specific voltage to a specific frequency.

26. The system according to claim 1, wherein the output of the amplifier is coupled to the input of the transmit antenna.

27. The system according to claim 26, wherein the receive antenna, the transmit antenna, the receiver, the transmitter and the amplifier are configured to form an oscillator.

28. The system according to claim 1, wherein the frequency transmitted from the transmit antenna sweeps from a first low frequency not less than about 3 MHz to a second higher frequency not greater than about 3 GHz.

29. The system according to claim 1, wherein the frequency transmitted from the transmit antenna sweeps forward from a first low frequency to a second higher frequency and then sweeps back from the second higher frequency to the first lower frequency.

30. The system according to claim 29, wherein the forward frequency sweep is out of phase with the back frequency sweep.

31. The system according to claim 1, wherein a reactive jamming unit and an active jamming unit are mounted on the same vehicle and coupled together with a tether through which the blanking pulse from the blanking pulse generator of the reactive unit is transmitted to the active unit to blank all the transmitters in the active unit.

32. The system according to claim 31, wherein the reactive jamming unit is configured to continue reactive jamming concentrating on select frequency bands when a potential threat signal is detected by the detector, while the active unit continues active jamming, except for when the transmitters in the active unit are blanked by the reactive unit.

33. The system according to claim 1, further including a local oscillator and two additional mixers coupled to the local oscillator, wherein the frequency modulated signal provided by the radio frequency generator is supplied to the input of the first additional mixer and the signal from the local oscillator is supplied to the second input of the first additional mixer; the output of the first additional mixer is supplied to the input of the signal mixer which also receives the signal from the receive antenna; the output of the signal mixer is provided to the input of the second additional mixer and the output from the local oscillator is also supplied to the input of the second additional mixer, wherein the output of the second mixer is supplied to the detector.

34. The system according to claim 1, further comprising at least three grounding planes for the transmit antenna, the grounding planes comprising conductive plates electrically isolated from the transmit antenna, wherein the transmit antenna is planar in shape and includes a first insulating substrate extending in the plane of the transmit antenna and a radiating element, and the transmit antenna is oriented to transmit electromagnetic radiation which is circularly polarized.

* * * * *